US008818238B2

(12) United States Patent
Sato et al.

(10) Patent No.: US 8,818,238 B2
(45) Date of Patent: Aug. 26, 2014

(54) IMAGE FORMING APPARATUS AND TRANSFER DEVICE HAVING ATTACHABLE DEVELOPING UNIT

(75) Inventors: Masahiro Sato, Kanagawa (JP); Atsuyuki Kitamura, Kanagawa (JP); Atsushi Ogihara, Kanagawa (JP); Tetsuji Okamoto, Kanagawa (JP); Koichi Watanabe, Kanagawa (JP); Shuichi Nishide, Kanagawa (JP); Wataru Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 308 days.

(21) Appl. No.: 13/247,284

(22) Filed: Sep. 28, 2011

(65) Prior Publication Data

US 2012/0251149 A1 Oct. 4, 2012

(30) Foreign Application Priority Data

Mar. 28, 2011 (JP) ..... 2011-069717

(51) Int. Cl.
*G03G 15/08* (2006.01)
*G03G 15/04* (2006.01)

(52) U.S. Cl.
USPC ..... 399/121; 399/19

(58) Field of Classification Search
USPC ..... 399/107, 110, 119, 121, 227, 303
See application file for complete search history.

(56) References Cited

U.S. PATENT DOCUMENTS

| | | | | |
|---|---|---|---|---|
| 5,262,824 | A * | 11/1993 | Morita et al. | 399/25 |
| 5,452,064 | A * | 9/1995 | Inomata | 399/299 |
| 7,400,838 | B2 | 7/2008 | Aratake et al. | |
| 7,697,868 | B2 * | 4/2010 | Kim | 399/167 |
| 2008/0145102 | A1 | 6/2008 | Katoh et al. | |

FOREIGN PATENT DOCUMENTS

| | | | |
|---|---|---|---|
| EP | 651300 | A2 * | 5/1995 |
| JP | 03266858 | A * | 11/1991 |
| JP | A-4-128771 | | 4/1992 |
| JP | 07253700 | A * | 10/1995 |
| JP | 08262956 | A * | 10/1996 |
| JP | 2003098823 | A * | 4/2003 |
| JP | A-2007-212843 | | 8/2007 |

* cited by examiner

*Primary Examiner* — Robert Beatty
(74) *Attorney, Agent, or Firm* — Oliff PLC

(57) ABSTRACT

An image forming apparatus includes a main body portion including an image carrier, an image-carrier driving unit, a latent-image forming unit, a developing-unit attachment section, and a transfer-unit attachment section. The developing-unit attachment section receives a first developing unit having plural developing members or a second developing unit having a single developing member. The transfer-unit attachment section receives a first transfer unit, which includes a first transfer member capable of retaining a recording medium and a first transfer driving unit that rotates the first transfer member, and a second transfer unit, which includes a second transfer member that cannot retain the recording medium. When the first developing unit and the first transfer unit are attached to the developing-unit attachment section and the transfer-unit attachment section, respectively, the first transfer driving unit is mechanically connected to the first developing unit.

7 Claims, 14 Drawing Sheets

IMAGE FORMING APPARATUS AND TRANSFER DEVICE HAVING ATTACHABLE DEVELOPING UNIT

CROSS-REFERENCE TO RELATED APPLICATIONS

This application is based on and claims priority under 35 USC 119 from Japanese Patent Application No. 2011-069717 filed Mar. 28, 2011.

BACKGROUND

The present invention relates to an image forming apparatus and a transfer device.

SUMMARY

According to an aspect of the present invention, an image forming apparatus includes a main body portion including an image carrier that is rotatable, an image-carrier driving unit that rotates the image carrier, a latent-image forming unit that forms an electrostatic latent image on the image carrier, a developing-unit attachment section to which a developing unit is attached, and a transfer-unit attachment section to which a transfer unit is attached. The developing unit develops the electrostatic latent image that is formed on the image carrier by the latent-image forming unit. The transfer unit faces the image carrier and is rotatable. The transfer unit transfers an image formed on the image carrier by the latent-image forming unit and the developing unit attached to the developing-unit attachment section onto a recording medium interposed between the transfer unit and the image carrier at a transfer position at which the transfer unit faces the image carrier. The developing-unit attachment section provided in the main body portion is capable of receiving, as the developing unit, a first developing unit or a second developing unit, the first developing unit having plural developing members and the second developing unit having a single developing member. The transfer-unit attachment section provided in the main body portion is capable of receiving, as the transfer unit, a first transfer unit or a second transfer unit, the first transfer unit including a first transfer member that is rotatable and has a function of retaining the recording medium and a first transfer driving unit that rotates the first transfer member, and the second transfer unit including a second transfer member that is rotatable and that does not have a function of retaining the recording medium. When the first developing unit is attached to the developing-unit attachment section provided in the main body portion and the first transfer unit is attached to the transfer-unit attachment section provided in the main body portion, the first transfer driving unit provided in the first transfer unit is mechanically connected to the first developing unit.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the accompanying drawings.

Figure 1:
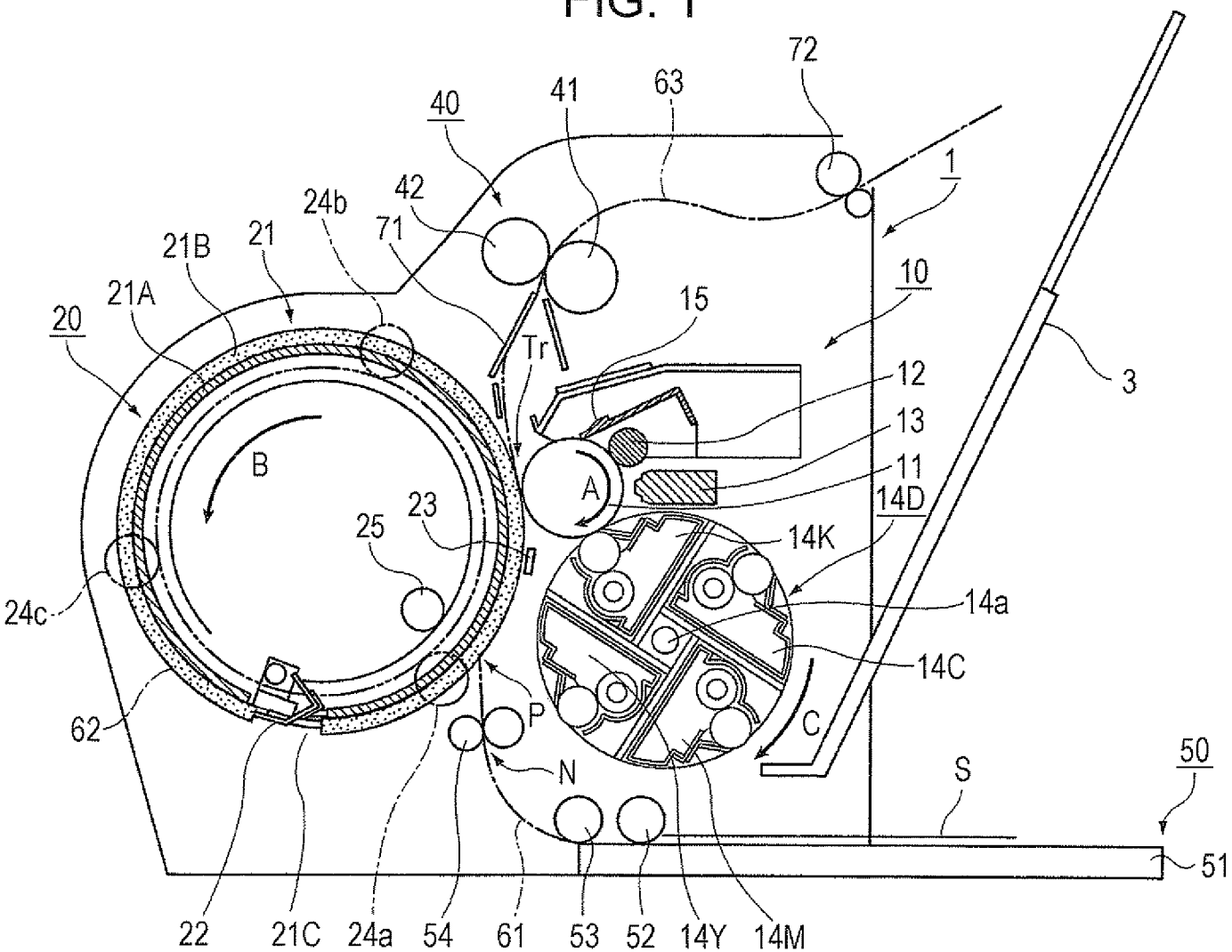
FIG. 1 illustrates an image forming apparatus according to an exemplary embodiment in a first state in which the image forming apparatus functions as a monochrome-color apparatus.
Figure 2:
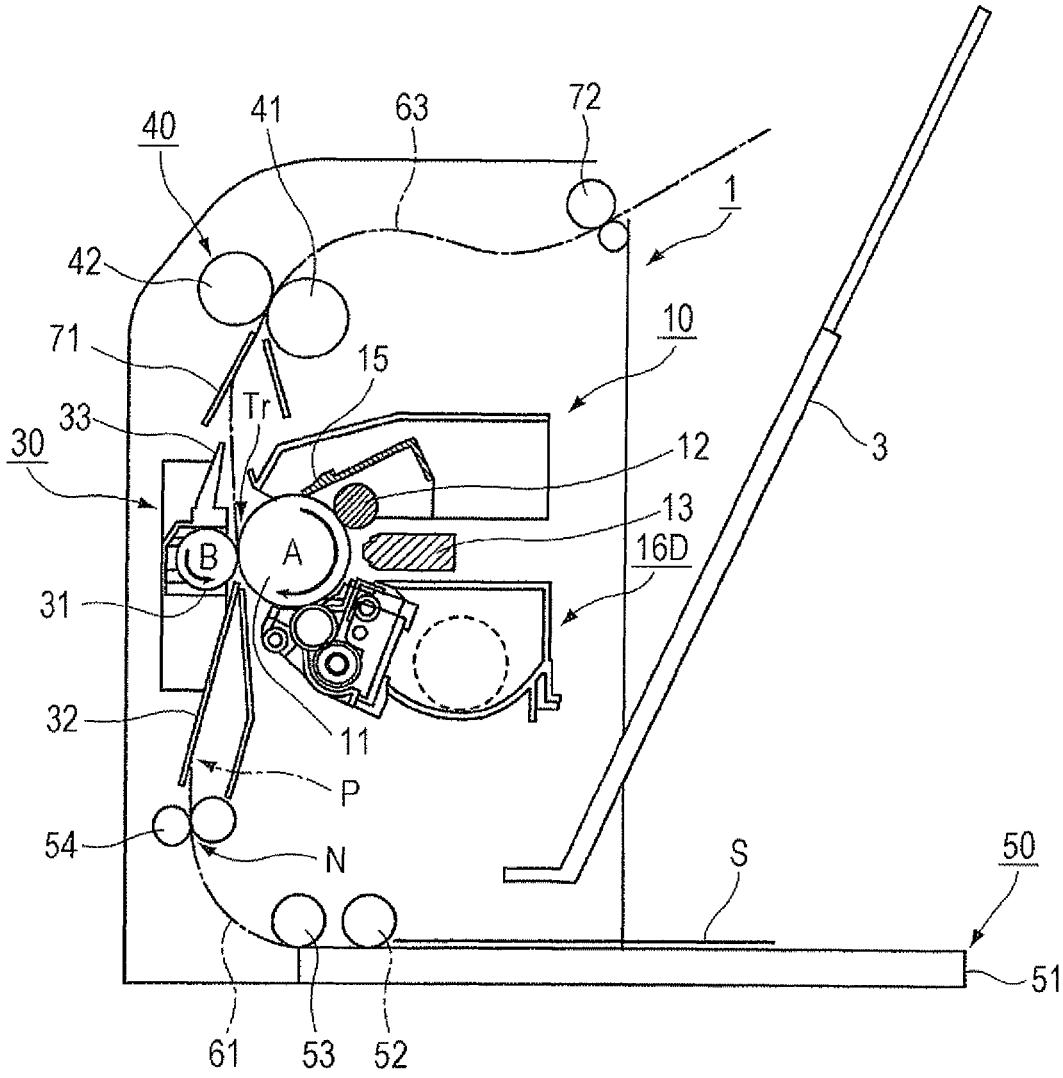
FIG. 2 illustrates the image forming apparatus according to the exemplary embodiment in a second state in which the image forming apparatus functions as a monochrome-only apparatus.

FIG. 1 illustrates an image forming apparatus according to the exemplary embodiment in a first state, and FIG. 2 illustrates the image forming apparatus in a second state. This image forming apparatus includes a main body unit 1 (described in detail below) to which plural units are attached. Some of the units may be replaced with other units by a service person or a user. Accordingly, the image forming apparatus functions as either a monochrome-color apparatus capable of forming monochrome and color images (first state illustrated in FIG. 1) or a monochrome-only apparatus capable of forming monochrome images only (second state illustrated in FIG. 2). The units to be replaced to switch the image forming apparatus between the first state and the second state will be described below.

The structure of the image forming apparatus set to the first state to function as the monochrome-color apparatus will be described with reference to FIG. 1.

The image forming apparatus set to the first state includes an image forming unit 10 that forms a toner image; a first transfer unit 20 that transfers the toner image formed by the image forming unit 10 onto a sheet of paper S, which is an example of a recording medium; a fixing unit 40 that fixes the toner image transferred onto the sheet of paper S by the first transfer unit 20 to the sheet of paper S; and a paper feed unit 50 that supplies the sheet of paper S to the first transfer unit 20. A paper receiver 3 on which sheets of paper S ejected from the fixing unit 40 are stacked is provided at the right side of the main body unit 1, which includes a photoconductor drum 11 and other components, in FIG. 1.

In the first state, the image forming unit 10 includes the photoconductor drum 11, a charging device 12, an exposure device 13, a rotary developing device 14D, and a cleaning device 15. The charging device 12 charges the photoconductor drum 11. The exposure device 13 subjects the charged photoconductor drum 11 to an exposure process. The rotary developing device 14D develops an electrostatic latent image, which is formed on the photoconductor drum 11 by the charging and exposure processes, with toner into a toner image. The cleaning device 15 removes toner and other matters that remain on the photoconductor drum 11 after the developed toner image has been transferred.

The photoconductor drum 11 is an example of an image carrier, and a photosensitive layer (not shown) is formed on the surface thereof. The photoconductor drum 11 is rotatable around a rotational shaft (not shown) in the direction shown by arrow A. The charging device 12, the exposure device 13, the rotary developing device 14D, and the cleaning device 15 are arranged around the photoconductor drum 11 in that order in the direction shown by arrow A. The outer diameter of the photoconductor drum 11 is, for example, 30 mm.

In the present exemplary embodiment, the charging device 12 includes a contact-roller discharge device that charges the photoconductor drum 11 while rotating together with the photoconductor drum 11.

The exposure device 13 forms an electrostatic latent image on the surface of the charged photoconductor drum 11 by selectively irradiating the surface with light. The exposure device 13 according to the present exemplary embodiment includes plural light-emitting elements (for example, light emitting diodes (LEDs)) that are arranged in the axial direction of the photoconductor drum 11.

In the present exemplary embodiment, the charging device 12 and the exposure device 13 form a latent-image forming unit.

The rotary developing device 14D is an example of a rotary developing unit, and includes a rotational shaft 14*a* and yellow (Y), magenta (M), cyan (C), and black (K) developing members 14Y, 14M, 14C, and 14K. The rotational shaft 14*a* extends in the axial direction of the photoconductor drum 11. The developing members 14Y, 14M, 14C, and 14K are examples of plural developing members, and are arranged around the rotational shaft 14*a*. The rotary developing device 14D is configured to be rotatable around the rotational shaft 14*a* in the direction shown by arrow C, and one of the developing members is stopped at a position where the rotary developing device 14D faces the photoconductor drum 11 (hereinafter referred to as a "developing position"). The rotary developing device 14D develops the electrostatic latent image, which is formed on the photoconductor drum 11 by the exposure device 13, with toner contained on the developing member that is stopped at the developing position. In this example, when an image forming operation is not started, the rotary developing device 14D is stopped in the state in which the black developing member 14K is at the developing position, as illustrated in FIG. 1. The outer diameter of the rotary developing device 14D is, for example, 80 mm.

The cleaning device 15 removes the toner and other matters that remain on the surface of the photoconductor drum 11. In the present exemplary embodiment, the cleaning device 15 includes a blade-type cleaner.

The first transfer unit 20 includes a transfer drum 21, a leading-end gripper 22, a trailing-end gripper 23, a first support roller 24*a*, a second support roller 24*b*, a third support roller 24*c*, a drive roller 25, and a phase sensor (not shown). The transfer drum 21 faces the photoconductor drum 11 and is rotatably arranged so as to extend in the axial direction of the photoconductor drum 11. The leading-end gripper 22 retains the leading end of the sheet of paper S in a transporting direction thereof at the outer peripheral surface of the transfer drum 21. The trailing-end gripper 23 retains the trailing end of the sheet of paper S in the transporting direction thereof at the outer peripheral surface of the transfer drum 21. The first, second, and third support rollers 24*a*, 24*b*, and 24*c* are in contact with the outer peripheral surface of the transfer drum 21 and support the transfer drum 21 in a rotatable manner. The drive roller 25 is in contact with the inner peripheral surface of the transfer drum 21 and is rotatable. The transfer drum 21 is rotated by the drive roller 25, and the phase sensor (not shown) detects the phase of the transfer drum 21 that is rotated. The transfer drum 21 is configured to be rotatable in the direction shown by arrow B, so that the rotating direction of the transfer drum 21 is the same as the rotating direction of the photoconductor drum 11 (direction shown by arrow A) at the position where the transfer drum 21 and the photoconductor drum 11 face each other. The outer diameter of the transfer drum 21 is, for example, 120 mm. Thus, in the present exemplary embodiment, the outer diameter of the transfer drum 21 is set to be larger than the outer diameter of the photoconductor drum 11.

The transfer drum 21, which is an example of a first transfer member or a recording-medium retainer, includes a base portion 21A and an elastic layer 21B. The base portion 21A has a substantially cylindrical shape or a cylindrical shape and is open at both ends thereof in the axial direction, that is, at a front end at the side visible in FIG. 1 and a rear end at the side that is not visible in FIG. 1. The elastic layer 21B is provided on the outer peripheral surface of the base portion 21A. The elastic layer 21B is C-shaped in cross section, as illustrated in FIG. 1, and covers a part of the outer peripheral surface of the base portion 21A excluding a certain area that extends in the axial direction of the base portion 21A. A part of the outer peripheral surface of the base portion 21A of the transfer drum 21 that is not covered by the elastic layer 21B serves as an exposed portion 21C at which the base portion 21A is exposed. The circumference of the elastic layer 21B is set to be larger than the length of a sheet of paper S of the maximum size that may be used in the image forming apparatus.

According to the present exemplary embodiment, the base portion 21A is formed of a conductive hollow tube that is made of, for example, a metal. The elastic layer 21B is formed of a semiconductive elastic member that is made of, for example, a resin such as polyurethane. A transfer bias with a polarity opposite to the polarity of the toner is applied to the base portion 21A by a high-voltage power source. The photoconductor drum 11 is grounded.

In the following description, the position at which the photoconductor drum 11 and the transfer drum 21 face each other is called a transfer position Tr. In the first state, the photosensitive layer provided on the photoconductor drum 11 and the elastic layer 21B included in the transfer drum 21 are in contact with each other at the transfer position Tr, thereby forming a transfer nip portion.

The leading-end gripper 22 is provided on the outer peripheral surface of the transfer drum 21 so as to extend along a rotational shaft of the transfer drum 21 at a position where the leading-end gripper 22 overlaps the exposed portion 21C and a front end of the elastic layer 21B in the rotational direction. The leading-end gripper 22 is attached to the transfer drum 21, and rotates together with the transfer drum 21 when the transfer drum 21 is rotated.

The leading-end gripper 22 includes a pinching member that rotates around a shaft provided on the transfer drum 21, the shaft extending along the rotational shaft of the transfer drum 21. The pinching member rotates in the positive or reverse direction around the shaft. Accordingly, an end portion of the sheet of paper S at the leading end thereof in the transporting direction (hereinafter referred to as the leading end of the sheet of paper S) is retained between the pinching member and the transfer drum 21 or is released. In the following description, the state of the leading-end gripper 22 in which the sheet of paper S is retained on the transfer drum 21 is referred to as a "closed" state, and the state of the leading-end gripper 22 in which the sheet of paper S is not retained on the transfer drum 21 is referred to as an "open" state.

The trailing-end gripper 23 is provided at the outer peripheral surface of the transfer drum 21 so as to extend along the rotational shaft of the transfer drum 21. The trailing-end gripper 23 is rotatable relative to the transfer drum 21, and is capable of rotating and stopping independently of the transfer drum 21. Thus, in the present exemplary embodiment, the positional relationship (distance) between the leading-end gripper 22 and the trailing-end gripper 23 on the outer peripheral surface of the transfer drum 21 is changeable.

The trailing-end gripper 23 includes a band-shaped pressing member that extends along the outer peripheral surface of the transfer drum 21 in the axial direction thereof. The pressing member moves toward or away from the outer peripheral surface of the transfer drum 21. Accordingly, an end portion of the sheet of paper S at the trailing end thereof in the transporting direction (hereinafter referred to as the trailing end of the sheet of paper S) is retained between the pressing member and the transfer drum 21 or is released. In the following description, the state of the trailing-end gripper 23 in which the sheet of paper S is retained on the transfer drum 21 is referred to as a "closed" state, and the state of the trailing-end gripper 23 in which the sheet of paper S is not retained on the transfer drum 21 is referred to as an "open" state.

The first support roller 24*a*, the second support roller 24*b*, and the third support roller 24*c*, which are examples of support members, are arranged at constant intervals (120°) around the rotational center of the transfer drum 21. The first support roller 24*a*, the second support roller 24*b*, and the third support roller 24*c* are disposed at positions separated from the transfer position Tr and outside both ends of the elastic layer 215 included in the transfer drum 21 in the axial direction thereof.

The drive roller 25, which is an example of a transmitting member, is formed of a roller member including an outer peripheral portion made of an elastic material, such as rubber. The drive roller 25 receives a driving force (rotating force) from the outside and transmits the received force to the inner peripheral surface of the transfer drum 21, thereby rotating the transfer drum 21 in the direction shown by arrow B.

The phase sensor (not shown) is arranged so as to face the outer peripheral surface of the transfer drum 21, and determines the phase of the transfer drum 21 that rotates by detecting a mark (not shown) provided on the outer peripheral surface of the transfer drum 21.

The fixing unit 40 includes a heating roller 41 and a pressing roller 42. The heating roller 41 includes a heater (not shown) and is arranged in a rotatable manner. The pressing roller 42 is in contact with the heating roller 41 such that a fixing nip portion is formed between the heating roller 41 and the pressing roller 42.

The paper feed unit 50 includes a paper container 51, a pickup roller 52, a separation roller 53, and a pair of supply rollers 54. The paper container 51 is arranged so as to extend from a position below the image forming unit 10 to a position below the paper receiver 3, and sheets of paper S are placed on the paper container 51. The pickup roller 52 feeds the sheets of paper S from the paper container 51. The separation roller 53 separates the sheets of paper S fed by the pickup roller 52 from each other. The supply rollers 54 supply each of the sheets of paper S that have been separated from each other by the separation roller 53 toward a downstream location (toward the outer peripheral surface of the transfer drum 21 in the first state) at an adjusted timing. In the following description, a portion at which each sheet of paper S is nipped by the supply rollers 54 is referred to as a supply nip portion N, and a position at which each sheet of paper S supplied by the supply rollers 54 reaches the outer peripheral surface of the transfer drum 21 is referred to as a paper supply position P.

In the first state, when the image forming operation is not started, the trailing-end gripper 23 is stopped at a position (standby position) that is upstream of the transfer position Tr and downstream of the paper supply position P in the rotational direction of the transfer drum 21 (direction shown by arrow B), as illustrated in FIG. 1.

In the following description, when the image forming apparatus is in the first state, a transport path of the sheet of paper S from the paper container 51 to the paper supply position P on the transfer drum 21 through the supply rollers 54 is referred to as a paper supply path 61. In addition, a transport path of the sheet of paper S along the outer peripheral surface of the transfer drum 21 is referred to as a rotation path 62, and a transport path of the sheet of paper S from the transfer position Tr to the paper receiver 3 through the fixing unit 40 is referred to as an paper output path 63.

The paper output path 63 is provided with a fixing guide 71 at a position between the transfer position Tr and the fixing unit 40. The fixing guide 71 guides the sheet of paper S that has passed through the transfer position Tr to the fixing unit 40. The paper output path 63 is also provided with a pair of paper output rollers 72 at a position between the fixing unit 40 and the paper receiver 3. The paper output rollers 72 transport the sheet of paper S that has passed through the fixing unit 40 toward the paper receiver 3.

In the present exemplary embodiment, the first transfer unit 20 may be detachably attached to the main body unit 1 of the image forming apparatus. In addition, a color developing unit 14 (described in detail below) which includes the rotary developing device 14D may also be detachably attached to the main body unit 1 of the image forming apparatus. The state of the image forming apparatus is changed from the first state illustrated in FIG. 1 to the second state illustrated in FIG. 2 when the first transfer unit 20 is replaced with a second transfer unit 30 (described in detail below) and the color developing unit 14 is replaced with a monochrome developing unit 16 (described in detail below) which includes a monochrome developing member 16D.

The structure of the image forming apparatus set to the second state to function as the monochrome-only apparatus will be described with reference to FIG. 2.

In the image forming apparatus set to the second state, the image forming unit 10, the fixing unit 40, and the paper feed unit 50 are the same as those in the first state. However, the rotary developing device 14D used in the first state is replaced by the monochrome developing member 16D, and the first transfer unit 20 used in the first state is replaced by the second transfer unit 30. Accordingly, the image forming unit 10 in the second state includes the photoconductor drum 11, the charging device 12, the exposure device 13, the monochrome developing member 16D, and the cleaning device 15.

Different from the above-described rotary developing device 14D, the monochrome developing member 16D, which is an example of a single developing member, is fixed to a developing position at which the monochrome developing member 16D faces the photoconductor drum 11. The monochrome developing member 16D develops the electrostatic latent image, which is formed on the photoconductor drum 11 by the exposure device 13, with toner contained therein. Although the color of the toner contained in the monochrome developing member 16D is not particularly limited, black toner is generally used.

The second transfer unit 30 includes a transfer roller 31 that faces the photoconductor drum 11 and that is rotatably arranged so as to extend in the axial direction of the photoconductor drum 11. Similar to the transfer drum 21, the transfer roller 31, which is an example of a second transfer member, rotates in the direction shown by arrow B, so that the rotating direction of the transfer roller 31 is the same as the rotating direction of the photoconductor drum 11 (direction shown by arrow A) at the position where the transfer roller 31 and the photoconductor drum 11 face each other. However, different from the above-described transfer drum 21, the transfer roller 31 does not have its own drive source, and is rotated by a driving force received from the photoconductor drum 11. The outer diameter of the transfer roller 31 is, for example, 15 mm. Thus, in the present exemplary embodiment, the outer diameter of the transfer roller 31 is smaller than the outer diameter of the transfer drum 21, and is also smaller than the outer diameter of the photoconductor drum 11. The circumference of the transfer roller 31 is set to be smaller than the length of a sheet of paper S of the maximum size that may be used in the image forming apparatus set to the second state.

In the present exemplary embodiment, the transfer roller 31 is produced by coating an urethane foam rubber roller in which carbon is dispersed with fluorine. The volume resistivity of the transfer roller 31 is set in the range of $10^3$ Ω·cm to $10^{10}$ Ω·cm. Different from the transfer drum 21, the outer peripheral surface of the transfer roller 31 is entirely covered, and the transfer roller 31 has a circular shape in cross section. Similar to the above-described transfer drum 21, a transfer bias with a polarity opposite to the polarity of the toner is applied to the transfer roller 31 by a high-voltage power source.

Similar to the above-described transfer drum 21, the transfer roller 31 is arranged so as to face the photoconductor drum 11 at the transfer position Tr. In the second state, the photosensitive layer provided on the photoconductor drum 11 and the transfer roller 31 are in contact with each other at the transfer position Tr, thereby forming a transfer nip portion.

The second transfer unit 30 further includes an entrance guide 32 that guides the sheet of paper S that has passed through the supply nip portion N to the transfer position Tr and an exit guide 33 that guides the sheet of paper S that has passed through the transfer position Tr to the fixing guide 71. In the second state, the paper supply position P in the first state does not exist since the transfer roller 31 is provided instead of the transfer drum 21. However, for convenience of explanation, a position corresponding to the paper supply position P in the first state is referred to as the paper supply position P in the second state. In this example, the position at which the sheet of paper S comes into contact with the entrance guide 32 corresponds to the paper supply position P.

Different from the above-described first transfer unit 20, the second transfer unit 30 does not include a mechanism for retaining the sheet of paper S on the transfer roller 31, that is, a mechanism corresponding to the leading-end gripper 22 and the trailing-end gripper 23.

Figure 3B:
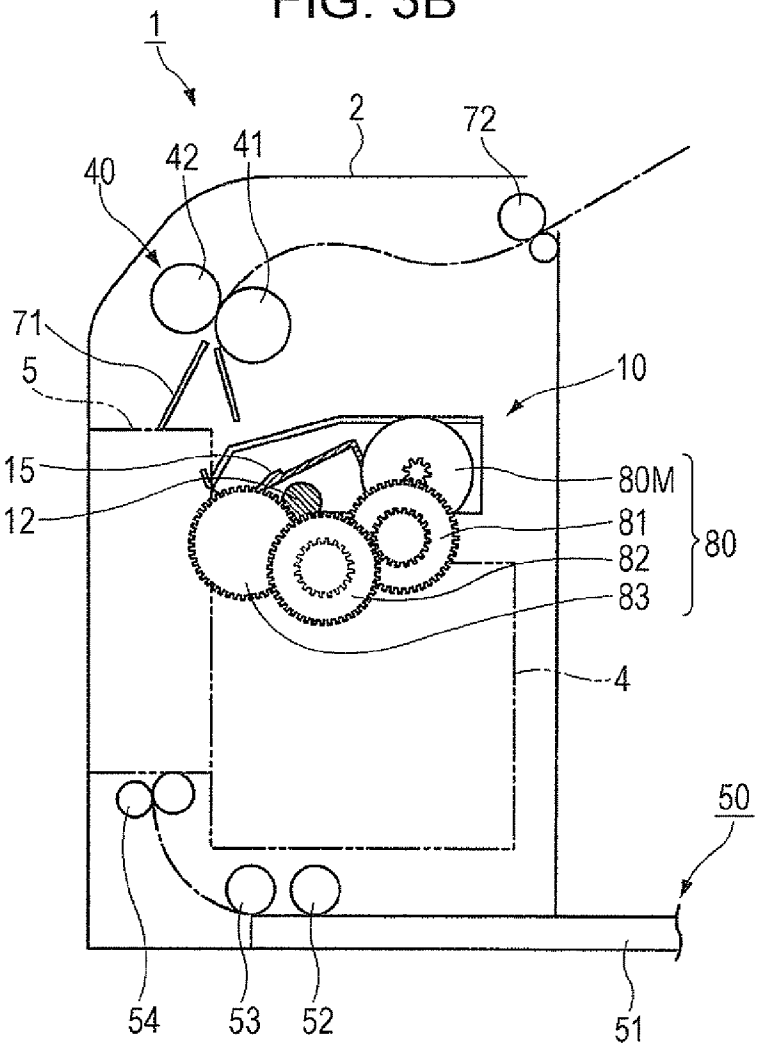
FIGS. 3A and 3B illustrate the structure of a main body unit.
Figure 3A:
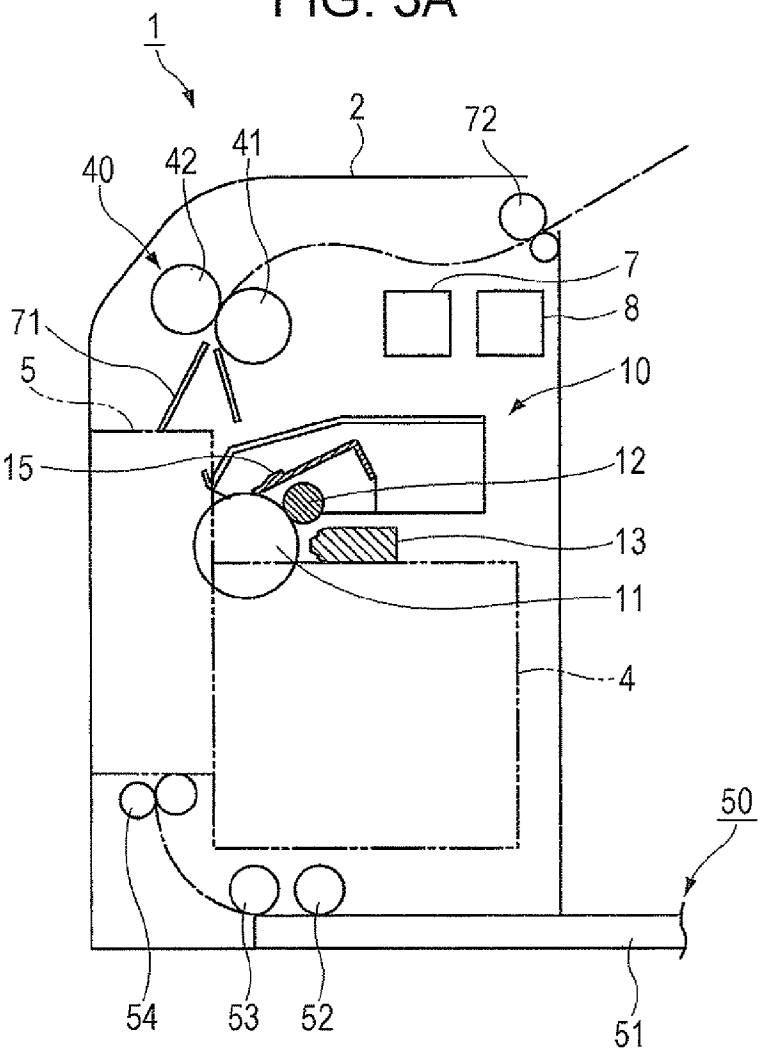

FIGS. 3A and 3B illustrate the structure of the main body unit 1, which is the base unit of the image forming apparatus that may be set to the first state and the second state. FIG. 3A illustrates the overall structure of the main body unit 1, and FIG. 3B illustrates the structure of a driving system in the main body unit 1. The paper receiver 3 is not shown in FIGS. 3A and 3B.

Referring to FIG. 3A, the main body unit 1, which is an example of a main body portion, includes the photoconductor drum 11, the charging device 12, the exposure device 13, and the cleaning device 15 in the image forming unit 10, the fixing unit 40 (the heating roller 41 and the pressing roller 42), the paper feed unit 50 (the paper container 51, the pickup roller 52, the separation roller 53, and the supply rollers 54), the fixing guide 71, and the paper output rollers 72, all of which are attached to a main body frame 2. The paper receiver 3 (not shown) is also a component of the main body unit 1 and is attached to the main body frame 2.

A developing-unit receiving section 4, which is an example of a developing-unit attachment section, is provided below the image forming unit 10 in the main body unit 1. The developing-unit receiving section 4 provides a space for receiving the color developing unit 14 (illustrated in FIGS. 4A to 4C described below) including the rotary developing device 14D or the monochrome developing unit 16 (illustrated in FIGS. 5A and 5B described below) including the monochrome developing member 16D. A transfer-unit receiving section 5, which is an example of a transfer unit attachment section, is provided on the left side of the image forming unit 10 in the main body unit 1. The transfer-unit receiving section 5 provides a space for receiving the first transfer unit 20 (illustrated in FIGS. 6A and 6B described below) or the second transfer unit 30 (illustrated in FIG. 8 described below).

The main body unit 1 includes a main-body power source 7 that functions as a power source for operating each part and a main-body controller 8 for controlling each part.

As illustrated in FIG. 3B, the main body unit 1 includes a main-body driving unit 80, which is a mechanism for driving each part.

The main-body driving unit 80, which is an example of an image-carrier driving unit, includes a main-body motor 80M that functions as a drive source; a main-body first gear 81 that meshes with a gear that is provided coaxially with the main-body motor 80M; a main-body second gear 82 that meshes with the main-body first gear 81; and a main-body third gear 83 that meshes with the main-body second gear 82. The main-body driving unit 80 is provided on the main body frame 2. The main-body third gear 83 is fixed to the rotational shaft of the photoconductor drum 11.

Figure 4A:
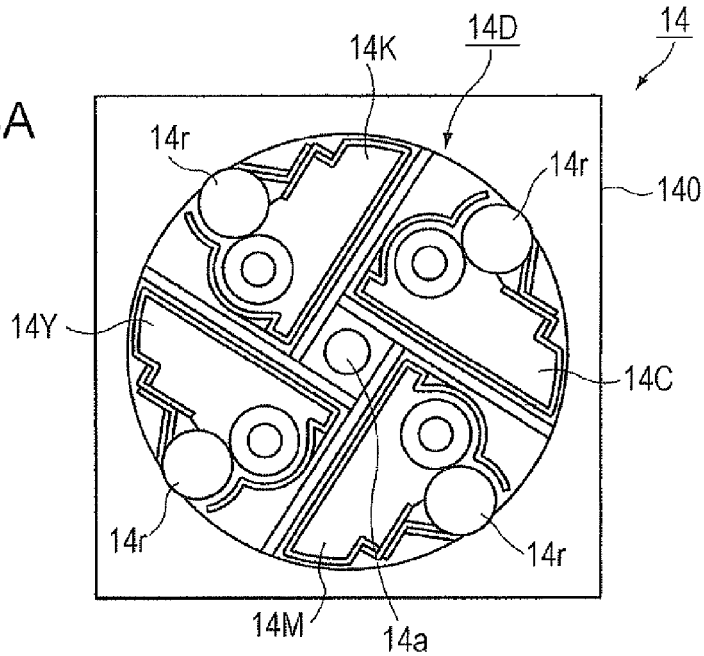
FIGS. 4A, 4B, and 4C illustrate the structure of a color developing unit.
Figure 4B:
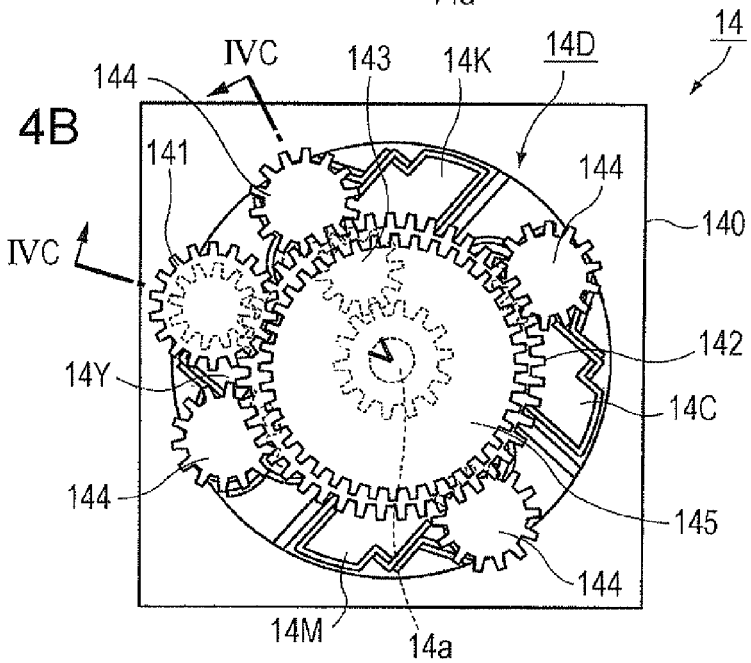
Figure 4C:
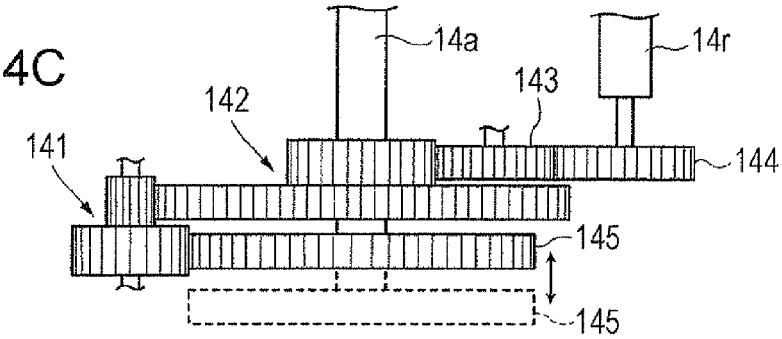

FIGS. 4A to 4C illustrate the structure of the color developing unit 14 used in the image forming apparatus in the first state. FIG. 4A illustrates the overall structure of the color developing unit 14. FIG. 4B illustrates the structure of a driving system in the color developing unit 14. FIG. 4C is a sectional view of FIG. 4B taken along line IVC-IVC.

Referring to FIG. 4A, the color developing unit 14, which is an example of a first developing unit, includes the rotary developing device 14D and a color-developing-unit frame 140 that contains the rotary developing device 14D and supports the rotary developing device 14D in a rotatable manner. The color-developing-unit frame 140 is shaped such that the color-developing-unit frame 140 may be housed in the developing-unit receiving section 4 (see FIGS. 3A and 3B) provided in the main body unit 1. Each of the yellow developing member 14Y, the magenta developing member 14M, the cyan developing member 14C, and the black developing member 14K provided in the rotary developing device 14D includes a housing (no reference numeral given) and a developing roller 14*r*. The housing has an opening that opens toward the outside, and contains the developer of the corresponding color. The developing roller 14*r* is rotatably disposed in the opening in the housing and transports the developer contained in the housing by retaining the developer on the outer peripheral surface thereof. The developing roller 14*r* is an example of a rotating member. When the developing member on which the developing roller 14*r* is attached is at the developing position, the developing roller 14*r* develops the electrostatic latent image formed on the photoconductor drum 11 with the developer retained on the outer peripheral surface thereof. A rotating member (e.g., an auger or a paddle) for stirring and transporting the developer contained in each developing member may be provided in the housing of the developing member as necessary.

As illustrated in FIGS. 4B and 4C, the color developing unit 14 includes a single color-developing-unit first gear 141, a single color-developing-unit second gear 142, a single color-developing-unit third gear 143, four color-developing-unit fourth gears 144, and a single color-developing-unit fifth gear 145. The color-developing-unit first gear 141 and the color-developing-unit third gear 143 are rotatably attached to the color-developing-unit frame 140. The color-developing-unit second gear 142 is rotatable relative to the rotational shaft 14*a* of the rotary developing device 14D, and the color-developing-unit fifth gear 145 is fixed to the rotational shaft 14*a* of the rotary developing device 14D. The four color-developing-unit fourth gears 144 are fixed to rotational shafts of the developing rollers 14*r* provided in the yellow developing member 14Y, the magenta developing member 14M, the cyan developing member 14C, and the black developing member 14K in the rotary developing device 14D. The color-developing-unit first gear 141 includes a large-diameter gear (hereinafter referred to as a large-diameter portion) and a small-diameter gear (hereinafter referred to as a small-diameter portion) that are integrated together. The color-developing-unit second gear 142 also includes a large-diameter gear (hereinafter referred to as a large-diameter portion) and a small-diameter gear (hereinafter referred to as a small-diameter portion) that are integrated together.

In the color developing unit 14, the small-diameter portion of the color-developing-unit first gear 141 and the large-diameter portion of the color-developing-unit second gear 142 mesh with each other, and the small-diameter portion of the color-developing-unit second gear 142 and the color-developing-unit third gear 143 mesh with each other. The color-developing-unit third gear 143 meshes with the color-developing-unit fourth gear 144 included in the developing member positioned at the developing position (the black developing member 14K in the example illustrated in FIGS. 4A to 4C). The color-developing-unit fourth gear 144 included in each developing member meshes with the color-developing-unit third gear 143 when the developing member reaches the developing position, as illustrated in FIGS. 4B and 4C. The color-developing-unit fifth gear 145 is movable together with the rotational shaft 14*a* toward the side visible in FIG. 4B and the side not visible in FIG. 4B (toward the bottom and top sides in FIG. 4C). In response to the movement of the color-developing-unit fifth gear 145, the color-developing-unit fifth gear 145 becomes connected to the large-diameter portion of the color-developing-unit first gear 141 (as shown by the solid lines in FIG. 4C) or disconnected from the large-diameter portion of the color-developing-unit first gear 141 (as shown by the dashed lines in FIG. 4C). The color-developing-unit fifth gear 145 is placed at the position shown by the solid lines when the rotary developing device 14D is to be rotated, and is placed at the position shown by the dashed lines when the rotation of the rotary developing device 14D is stopped to position one of the developing members at the developing position. The color-developing-unit second gear 142 is attached to the rotational shaft 14*a* by using, for example, a ball bearing, so that the connections between the color-developing-unit second gear 142 and the color-developing-unit first gear 141 and between the color-developing-unit second gear 142 and the color-developing-unit third gear 143 are not canceled even when the rotational shaft 14*a* is moved in the axial direction.

Although the color developing unit 14 includes the gear train that receives a driving force, the color developing unit 14 does not include a drive source, such as a motor.

Figure 5B:
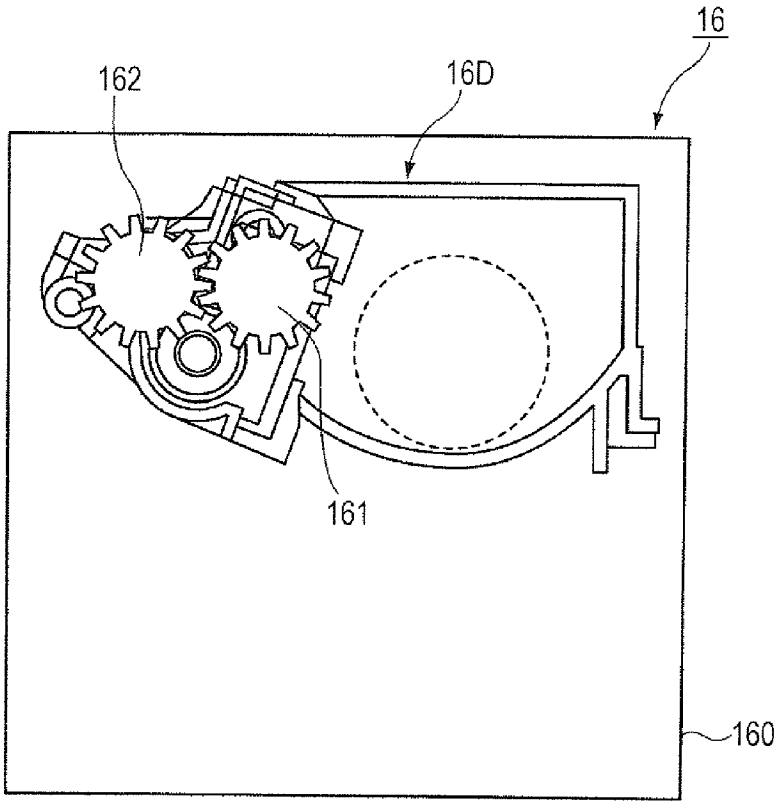
FIGS. 5A and 5B illustrate the structure of a monochrome developing unit.
Figure 5A:
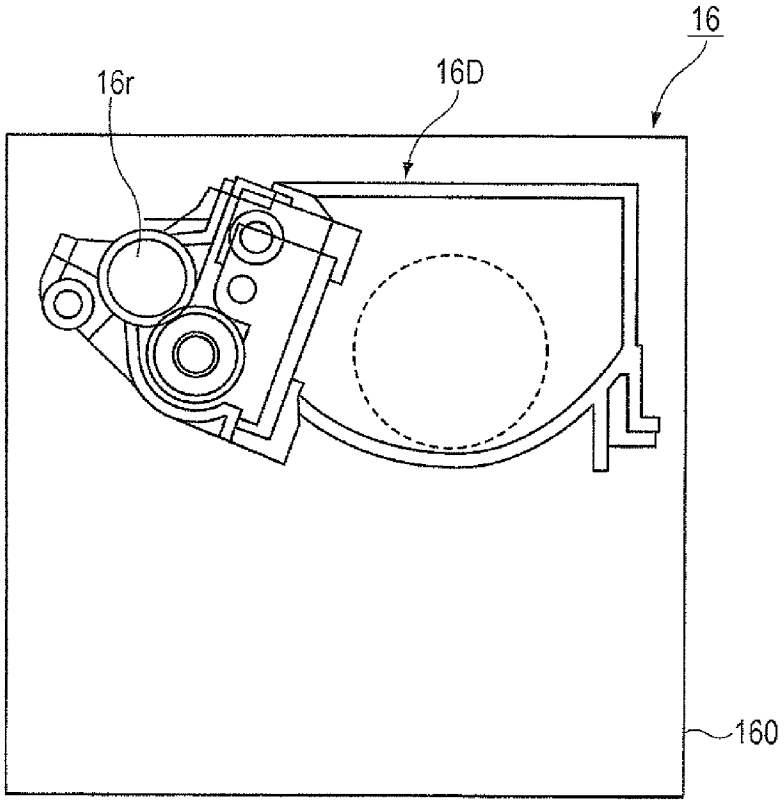

FIGS. 5A and 5B illustrate the structure of the monochrome developing unit 16 used in the image forming apparatus in the second state. FIG. 5A illustrates the overall structure of the monochrome developing unit 16. FIG. 5B illustrates the structure of a driving system in the monochrome developing unit 16.

Referring to FIG. 5A, the monochrome developing unit 16, which is an example of a second developing unit, includes the monochrome developing member 16D and a monochrome-developing-unit frame 160 that contains the monochrome developing member 16D and supports the monochrome developing member 16D in a fixed manner. The monochrome-developing-unit frame 160 is shaped such that the monochrome-developing-unit frame 160 may be housed in the developing-unit receiving section 4 (see FIGS. 3A and 3B) provided in the main body unit 1. Similar to the yellow developing member 14Y, etc., provided in the above-described rotary developing device 14D, the monochrome developing member 16D includes a housing (no reference numeral given) and a developing roller 16*r*. The housing has an opening that opens toward the outside, and contains the developer of a certain color (black in this example). The developing roller 16*r* is rotatably disposed in the opening in the housing and transports the developer contained in the housing by retaining the developer on the outer peripheral surface thereof. A rotating member (e.g., an auger or a paddle) for stirring and transporting the developer contained in the monochrome developing member 16D may be provided in the housing of the monochrome developing member 16D as necessary.

As illustrated in FIG. 5B, the monochrome developing unit 16 further includes a single monochrome-developing-unit first gear 161 and a single monochrome-developing-unit second gear 162. The monochrome-developing-unit first gear 161 is attached to the monochrome-developing-unit frame 160 in a rotatable manner. The monochrome-developing-unit second gear 162 is attached to a rotational shaft of the developing roller 16*r* provided in the monochrome developing member 16D.

In the monochrome developing unit 16, the monochrome-developing-unit first gear 161 and the monochrome-developing-unit second gear 162 mesh with each other.

Similar to the above-described color developing unit 14, although the monochrome developing unit 16 includes the gear train that receives a driving force, the monochrome developing unit 16 does not include a drive source, such as a motor.

Figure 6B:
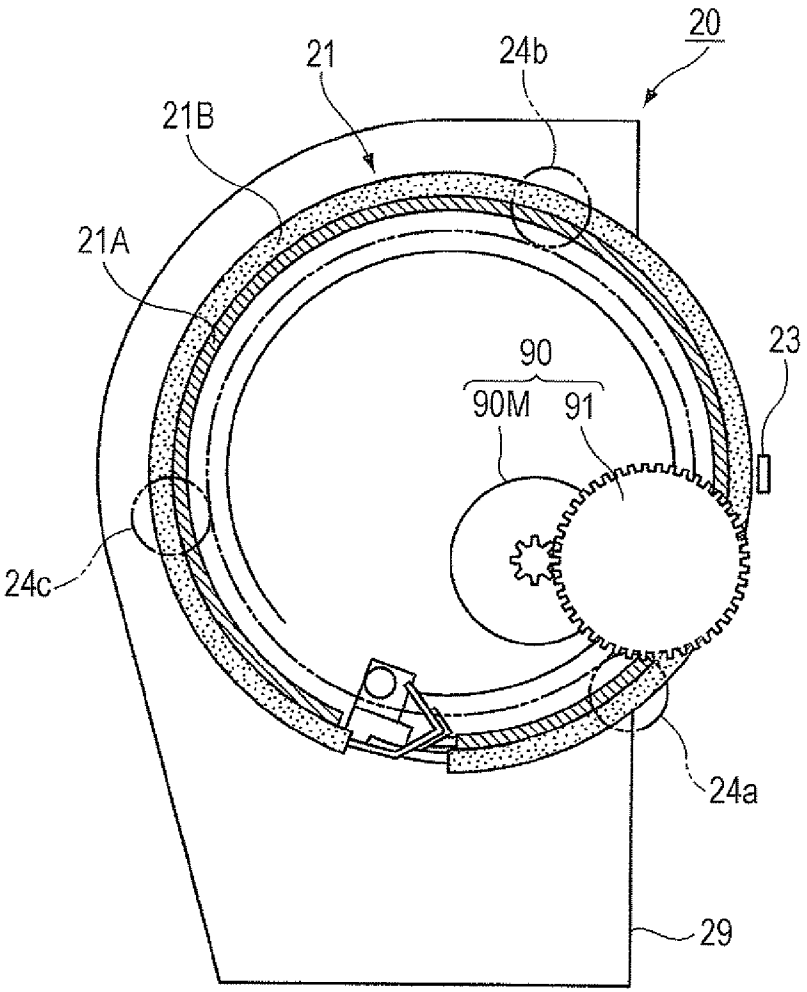
FIGS. 6A and 6B illustrate the structure of a first transfer unit.
Figure 6A:
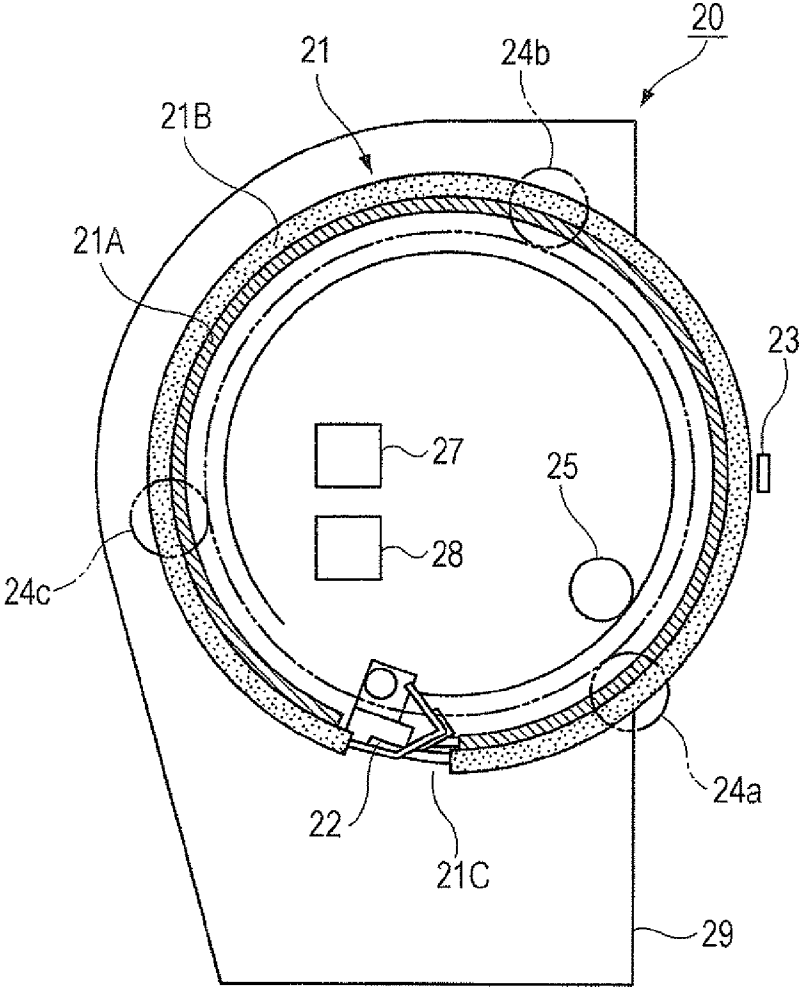

FIGS. 6A and 6B illustrate the structure of the first transfer unit 20 used in the image forming apparatus in the first state.

Figure 7:
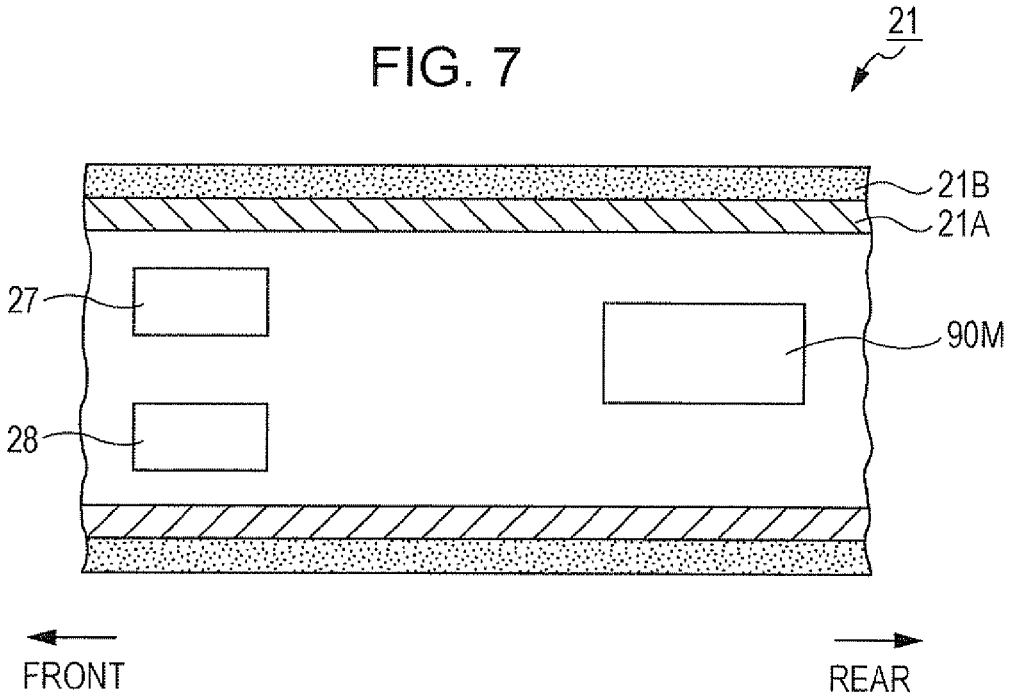
FIG. 7 illustrates the internal structure of a transfer drum included in the first transfer unit.

FIG. 6A illustrates the overall structure of the first transfer unit 20. FIG. 6B illustrates the structure of a driving system in the first transfer unit 20. FIG. 7 illustrates the inner structure of the transfer drum 21 included in the first transfer unit 20. In FIG. 7, the left side corresponds to the side visible in FIGS. 6A and 6B (front side), and the right side corresponds to the side that is not visible in FIGS. 6A and 6B (rear side).

As illustrated in FIG. 6A, the first transfer unit 20 includes the transfer drum 21, and also includes the leading-end gripper 22, the trailing-end gripper 23, the first support roller 24*a*, the second support roller 24*b*, the third support roller 24*c*, the drive roller 25, and the phase sensor (not shown), which are attached to the transfer drum 21. All of these components are attached to a first-transfer-unit frame 29. A part of the transfer drum 21 (right part in FIGS. 6A and 6B) in the first transfer unit 20 protrudes from the first-transfer-unit frame 29, and the protruding part may be placed in the transfer-unit receiving section 5 (see FIGS. 3A and 3B) provided in the main body unit 1.

In the first transfer unit 20, a first-transfer-unit power source 27 that functions as a power source for operating each part and a first-transfer-unit controller 28 for controlling each part are placed in the transfer drum 21, which is hollow and opens at both ends thereof, together with the above-described drive roller 25.

As illustrated in FIG. 6B, the first transfer unit 20 includes a first-transfer-unit driving unit 90, which is a mechanism for driving each part.

The first-transfer-unit driving unit 90, which is an example of a first transfer driving unit or a drive source, includes a first-transfer-unit motor 90M that functions as a drive source and a first-transfer-unit gear 91 that meshes with a gear that is provided coaxially with the first-transfer-unit motor 90M. The first-transfer-unit motor 90M is mechanically connected to the drive roller 25 illustrated in FIG. 6A by a gear or a gear train (not shown).

As illustrated in FIG. 7, the first-transfer-unit power source 27, the first-transfer-unit controller 28, and the first-transfer-unit motor 90M are fixed to inner portions of the transfer drum 21 at positions inside the openings at both ends of the transfer drum 21. The drive roller 25 (not illustrated in FIG. 7), which is disposed inside the transfer drum 21, is attached to the transfer drum 21 at positions where the drive roller 25 does not come into contact with the first-transfer-unit power source 27, the first-transfer-unit controller 28, and the first-transfer-unit motor 90M.

Figure 8:
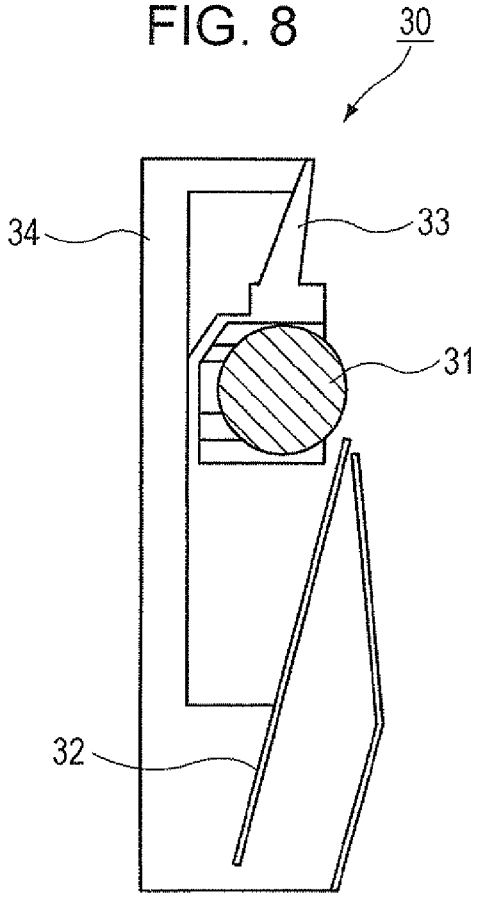
FIG. 8 illustrates the structure of a second transfer unit.

FIG. 8 illustrates the structure of the second transfer unit 30 used in the image forming apparatus in the second state.

As illustrated in FIG. 8, the second transfer unit 30 includes the transfer roller 31, the entrance guide 32, and the exit guide 33, all of which are attached to a second-transfer-unit frame 34. The second-transfer-unit frame 34 may be formed integrally with the entrance guide 32 and the exit guide 33. The second-transfer-unit frame 34 is shaped such that the second-transfer-unit frame 34 may be housed in the transfer-unit receiving section 5 (see FIGS. 3A and 3B) provided in the main body unit 1.

Different from the above-described first transfer unit 20, the second transfer unit 30 does not include a drive source, such as a motor, or a controller.

Figure 9:
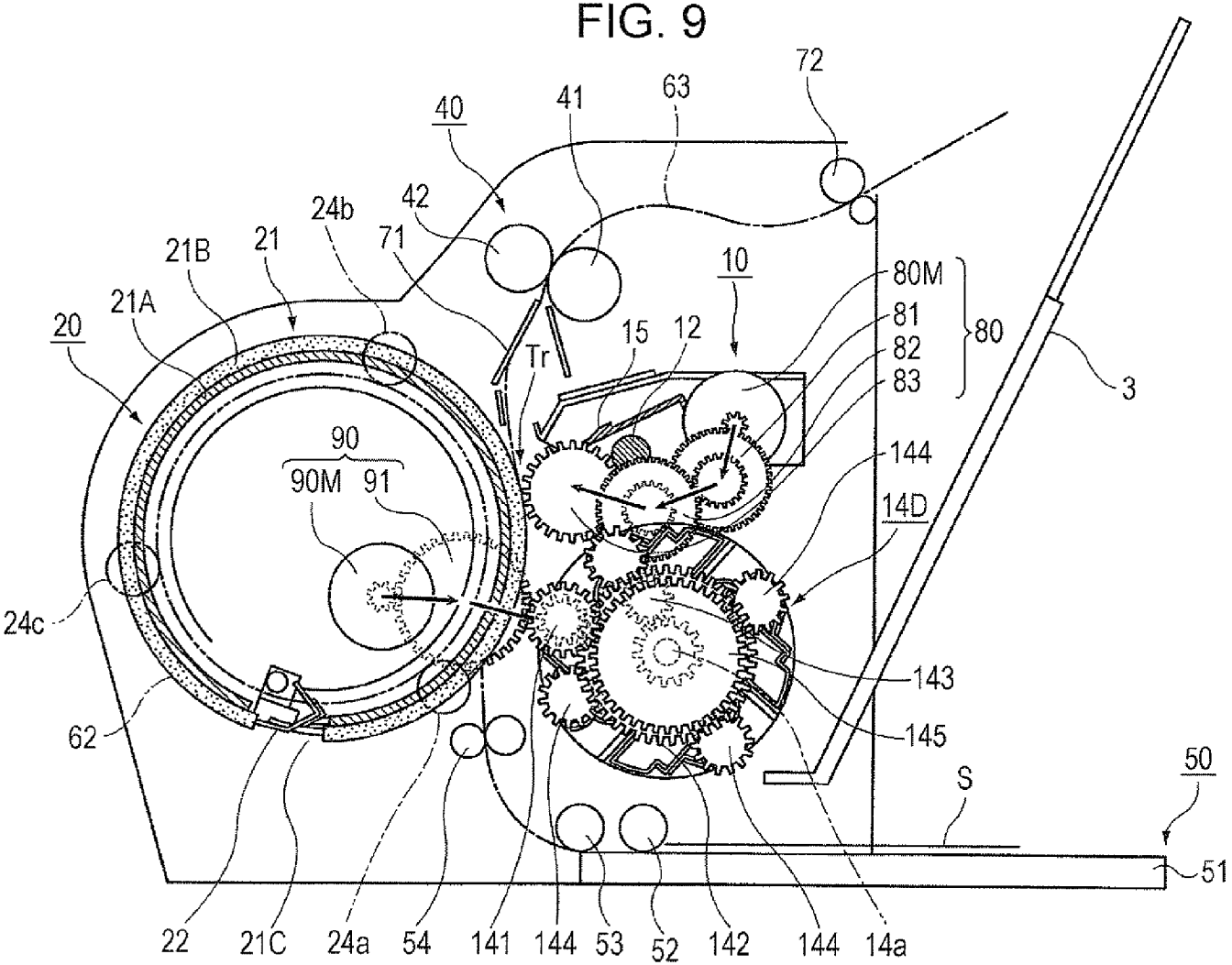
FIG. 9 illustrates the arrangement of a driving system in the image forming apparatus in the first state.

FIG. 9 illustrates the arrangement of a driving system in the image forming apparatus in the first state in which the color developing unit 14 illustrated in FIGS. 4A to 4C and the first transfer unit 20 illustrated in FIGS. 6A and 6B are attached to the main body unit 1 illustrated in FIGS. 3A and 3B.

When the image forming apparatus is set to the first state, the main-body motor 80M is connected to the photoconductor drum 11 by the main-body first gear 81, the main-body second gear 82, and the main-body third gear 83 in the main body unit 1. Therefore, in the first state, the photoconductor drum 11 provided in the main body unit 1 is rotated when the main-body motor 80M provided in the main body unit 1 is rotated.

In addition, when the image forming apparatus is set to the first state, the first-transfer-unit gear 91 provided in the first transfer unit 20 meshes with the color-developing-unit first gear 141 provided in the color developing unit 14. In the first state, the transfer drum 21 provided in the first transfer unit 20 is rotated when the first-transfer-unit motor 90M provided in the first transfer unit 20 is rotated. When the first-transfer-unit motor 90M is rotated, the color-developing-unit first gear 141 is also rotated. In response to the rotation of the first-transfer-unit motor 90M, the color-developing-unit fifth gear 145 moves in the axial direction of the rotational shaft 14*a* and meshes with the color-developing-unit first gear 141. Accordingly, the rotation of the color-developing-unit first gear 141 is transmitted through the color-developing-unit fifth gear 145 and the rotational shaft 14*a* to the rotary developing device 14D provided in the color developing unit 14, so that the rotary developing device 14D is rotated. When the rotary developing device 14D is rotated by, for example, 90°, one of the developing members reaches the developing position. Then, the color-developing-unit fifth gear 145 moves along the axial direction of the rotational shaft 14*a* (in a direction opposite to the above-described case), so that the color-developing-unit fifth gear 145 becomes disengaged from the color-developing-unit first gear 141. In addition, a stopper (not shown) is arranged to regulate the rotation of the rotary developing device 14D, so that the rotary developing device 14D is stopped in a state in which the desired developing member is at the developing position. The driving force is transmitted from the color-developing-unit first gear 141 through the color-developing-unit second gear 142 and the color-developing-unit third gear 143 to the color-developing-unit fourth gear 144 provided in one of the four developing members that is placed at the developing position in the rotary developing device 14D. As a result, the developing roller 14*r* included in the developing member at the developing position is rotated.

Thus, when the image forming apparatus is set to the first state, the photoconductor drum 11 that is originally provided in the main body unit 1 is mechanically driven by the main-body driving unit 80 that is also originally provided in the main body unit 1. The color developing unit 14 that is attached to the developing-unit receiving section 4 (see FIGS. 3A and 3B) in the main body unit 1 and the transfer drum 21 provided in the first transfer unit 20 that is attached to the transfer-unit receiving section 5 (see FIGS. 3A and 3B) in the main body unit 1 are mechanically driven by the first-transfer-unit driving unit 90 provided in the first transfer unit 20.

Figure 10:
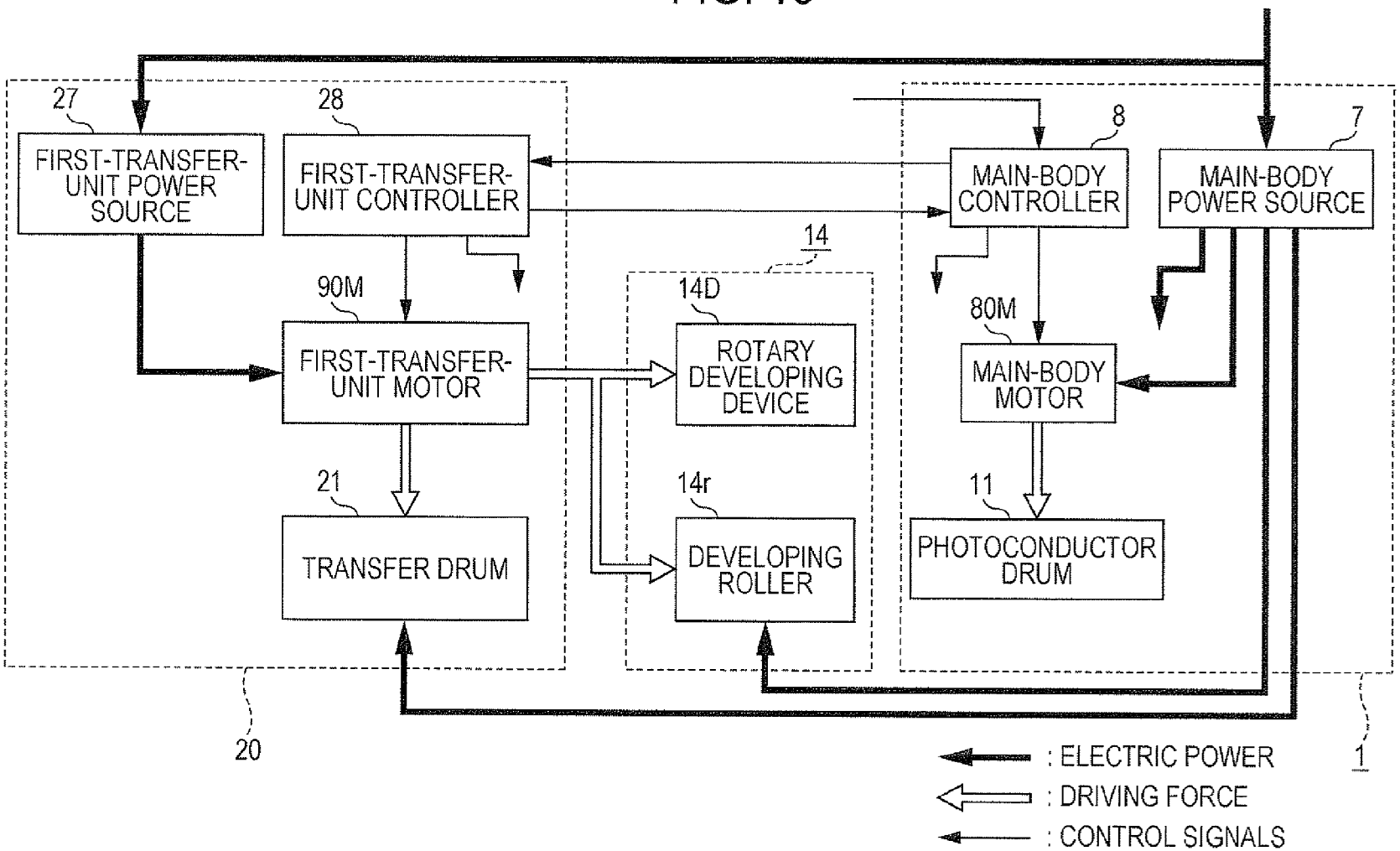
FIG. 10 is a block diagram illustrating the relationship between the driving system, a power supply system, and a control system in the image forming apparatus in the first state.

FIG. 10 is a block diagram illustrating the relationship between the driving system, a power supply system, and a control system in the image forming apparatus in the first state.

In the first state, electricity is supplied from, for example, a receptacle (not shown) to the main-body power source 7 in the main body unit 1 and the first-transfer-unit power source 27 in the first transfer unit 20. The main-body power source 7 supplies electricity to the main-body motor 80M that is originally provided in the main body unit 1, and also supplies electricity to other components (the charging device 12, the exposure device 13, the fixing unit 40, the paper feed unit 50, etc.) that are originally provided in the main body unit 1. The main-body power source 7 applies a developing bias to the developing roller 14*r* provided in one of the developing members that is placed at the developing position in the color developing unit 14 attached to the main body unit 1. The main-body power source 7 also applies a transfer bias to the transfer drum 21 in the first transfer unit 20 attached to the main body unit 1. The first-transfer-unit power source 27 supplies electricity to the first-transfer-unit motor 90M included in the first transfer unit 20, and also supplies electricity to other components (mechanisms for opening and closing the leading-end gripper 22 and the trailing-end gripper 23, a mechanism for rotating the trailing-end gripper 23, etc.) provided in the first transfer unit 20.

In the first state, the driving force of the main-body motor 80M provided in the main body unit 1 is transmitted to the photoconductor drum 11 provided in the main body unit 1. In addition, in the first state, the driving force of the first-transfer-unit motor 90M provided in the first transfer unit 20 is transmitted to the transfer drum 21 provided in the first transfer unit 20, the rotary developing device 14D provided in the color developing unit 14 attached to the main body unit 1, and the developing roller 14*r* attached to one of the developing members that is placed at the developing position in the rotary developing device 14D.

In addition, in the first state, control signals supplied from a computer device or a user interface device (not shown) are input to the main-body controller 8 provided in the main body unit 1. The main-body controller 8 outputs control signals to the main-body motor 80M that is originally provided in the main body unit 1, and also outputs control signals to other components (the charging device 12, the exposure device 13, the fixing unit 40, the paper feed unit 50, etc.) that are originally provided in the main body unit 1. The main-body controller 8 also outputs control signals to the first-transfer-unit controller 28 provided in the first transfer unit 20. The first-transfer-unit controller 28 outputs control signals to the first-transfer-unit motor 90M provided in the first transfer unit 20, and also outputs control signals to other components (the mechanisms for opening and closing the leading-end gripper 22 and the trailing-end gripper 23, etc.) provided in the first transfer unit 20. The first-transfer-unit controller 28 outputs control signals to the main-body controller 8 as necessary.

Thus, when the image forming apparatus is in the first state, electricity is supplied not only to the main-body power source 7 provided in the main body unit 1 but also to the first-transfer-unit power source 27 provided in the first transfer unit 20. In addition, when the image forming apparatus is in the first state, the main-body controller 8 provided in the main body unit 1 and the first-transfer-unit controller 28 provided in the first transfer unit 20 perform a control process in cooperation with each other.

Figure 11:
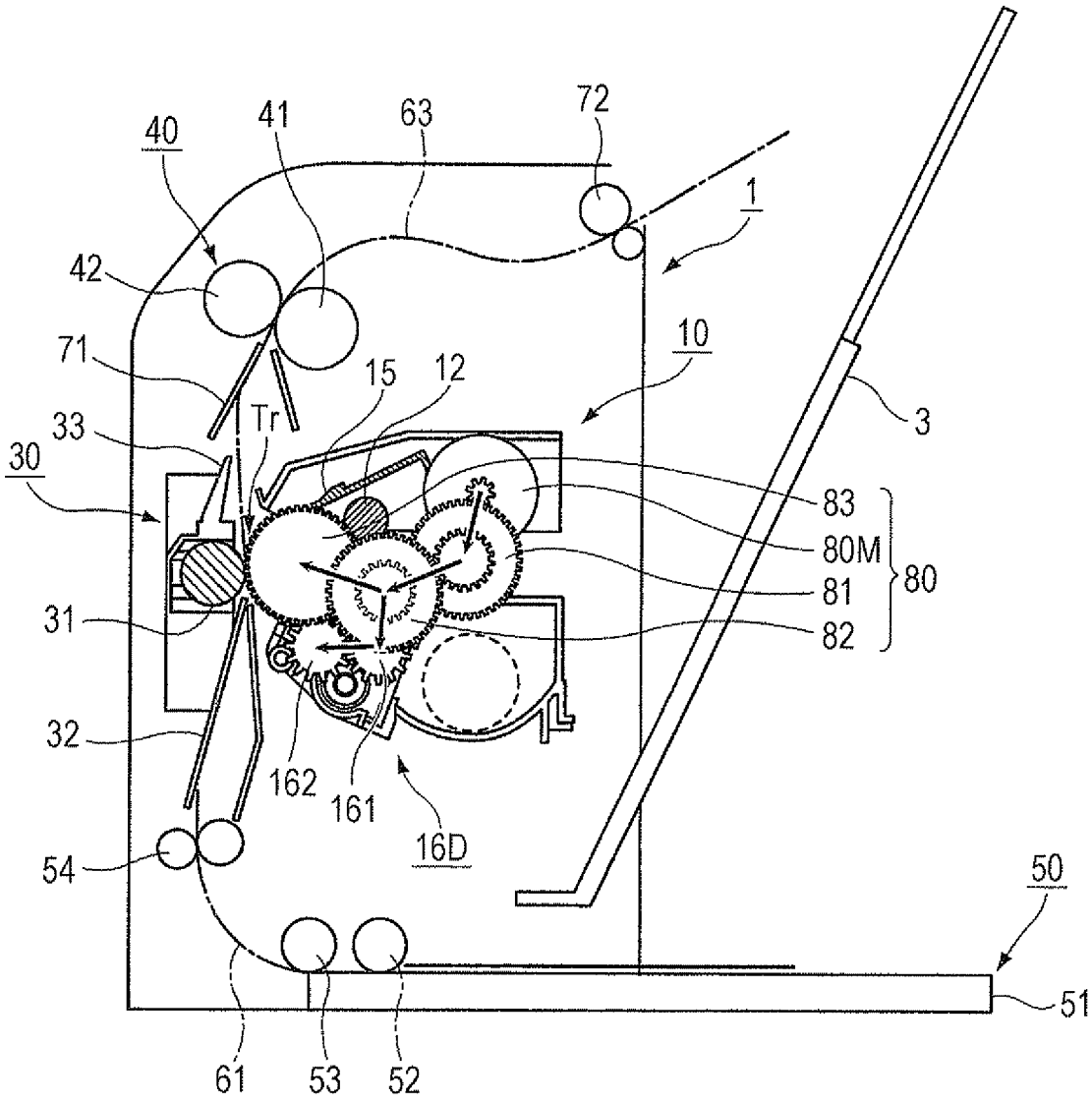
FIG. 11 illustrates the arrangement of a driving system in the image forming apparatus in the second state.

FIG. 11 illustrates the arrangement of a driving system in the image forming apparatus in the second state in which the monochrome developing unit 16 illustrated in FIGS. 5A and 5B and the second transfer unit 30 illustrated in FIG. 8 are attached to the main body unit 1 illustrated in FIGS. 3A and 3B.

Similar to the first state, when the image forming apparatus is set to the second state, the main-body motor 80M is connected to the photoconductor drum 11 by the main-body first gear 81, the main-body second gear 82, and the main-body third gear 83 in the main body unit 1. Therefore, also in the second state, the photoconductor drum 11 provided in the main body unit 1 is rotated when the main-body motor 80M provided in the main body unit 1 is rotated.

In the image forming apparatus set to the second state, the outer peripheral surface of the photoconductor drum 11 provided in the main body unit 1 is in contact with the outer peripheral surface of the transfer roller 31 provided in the second transfer unit 30. As described above, the outer diameter of the transfer roller 31 is set to be smaller than the diameter of the transfer drum 21. Therefore, the force required to rotate the transfer roller 31 is smaller than the force required to rotate the transfer drum 21. Therefore, in the second state, unlike the first state, the transfer roller 31 does not have its own drive source for rotating the transfer roller 31, so that the structure of the image forming apparatus in the second state is simplified. In the second state, when the main-body motor 80M provided in the main body unit 1 is rotated, the photoconductor drum 11 is also rotated. Accordingly, the transfer roller 31 receives a driving force from the photoconductor drum 11 and is rotated.

When the image forming apparatus is in the second state, the main-body second gear 82 provided in the main body unit 1 and the monochrome-developing-unit first gear 161 provided in the monochrome developing unit 16 mesh with each other. Therefore, in the second state, when the main-body motor 80M provided in the main body unit 1 is rotated, not only the above-described photoconductor drum 11 but also the developing roller 16*r* provided in the monochrome developing member 16D of the monochrome developing unit 16 is rotated.

Thus, when the image forming apparatus is set to the second state, the photoconductor drum 11 that is originally provided in the main body unit 1 is mechanically driven by the main-body driving unit 80 that is also originally provided in the main body unit 1. In addition, the monochrome developing unit 16 that is attached to the developing-unit receiving section 4 (see FIGS. 3A and 3B) in the main body unit 1 and the transfer roller 31 provided in the second transfer unit 30 that is attached to the transfer-unit receiving section 5 (see FIGS. 3A and 3B) in the main body unit 1 are also mechanically driven by the main-body driving unit 80 that is originally provided in the main body unit 1.

Figure 12:
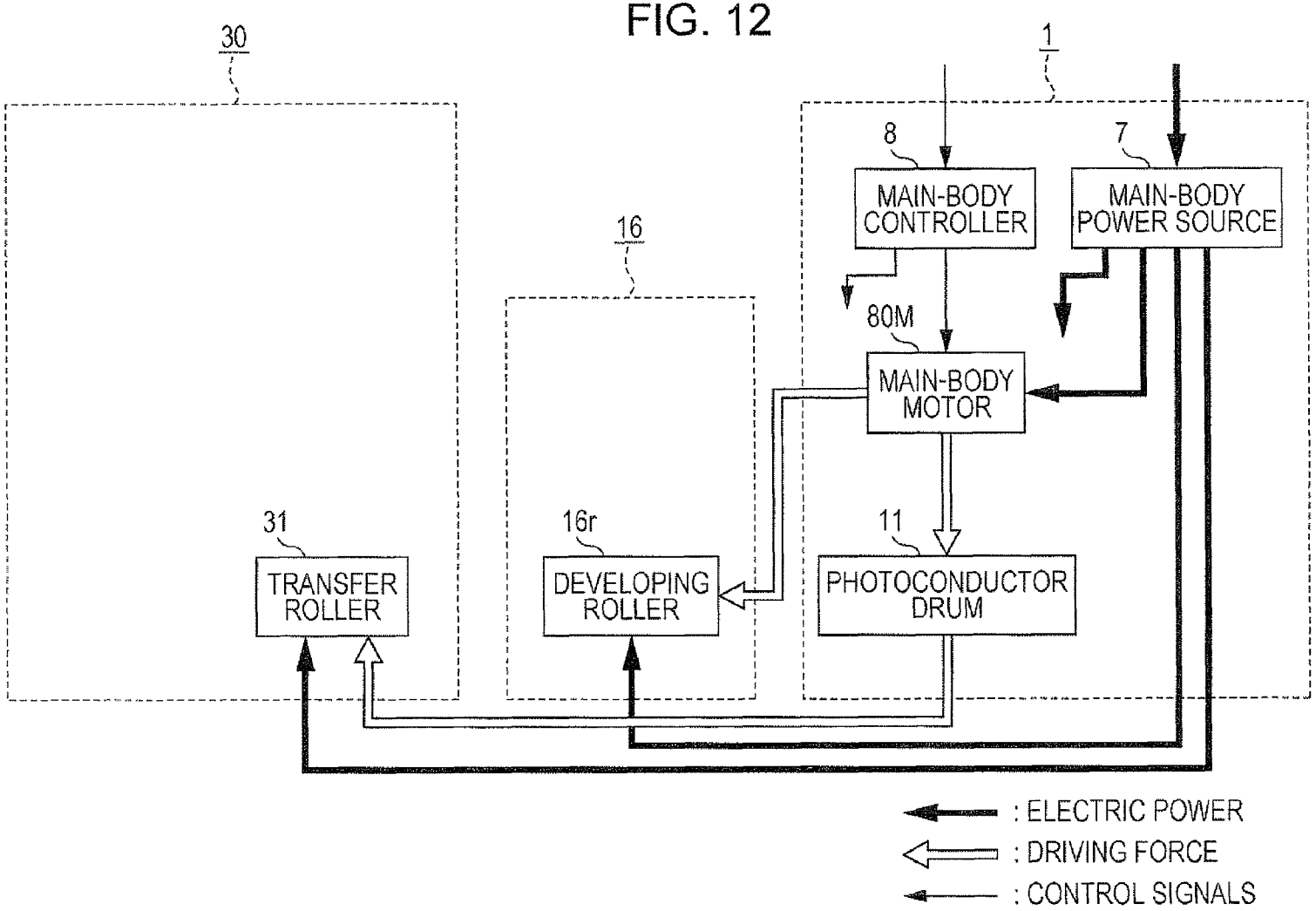
FIG. 12 is a block diagram illustrating the relationship between the driving system, a power supply system, and a control system in the image forming apparatus in the second state.

FIG. 12 is a block diagram illustrating the relationship between the driving system, a power supply system, and a control system in the image forming apparatus in the second state.

In the second state, electricity is supplied from, for example, a receptacle (not shown) to the main-body power source 7 in the main body unit 1. The main-body power source 7 supplies electricity to the main-body motor 80M that is originally provided in the main body unit 1, and also supplies electricity to other components (the charging device 12, the exposure device 13, the fixing unit 40, the paper feed unit 50, etc.) that are originally provided in the main body unit 1. The main-body power source 7 applies a developing bias to the developing roller 16*r* provided in the monochrome developing member 16D of the monochrome developing unit 16 that is attached to the main body unit 1. The main-body power source 7 also applies a transfer bias to the transfer roller 31 in the second transfer unit 30 attached to the main body unit 1.

In the second state, the driving force of the main-body motor 80M provided in the main body unit 1 is transmitted to the photoconductor drum 11 provided in the main body unit 1, the developing roller 16*r* provided in the monochrome developing unit 16 attached to the main body unit 1, and the transfer roller 31 provided in the second transfer unit 30 attached to the main body unit 1.

In addition, in the second state, control signals supplied from a computer device or a user interface device (not shown) are input to the main-body controller 8 provided in the main body unit 1. The main-body controller 8 outputs control signals to the main-body motor 80M that is originally provided in the main body unit 1, and also outputs control signals to other components (the charging device 12, the exposure device 13, the fixing unit 40, the paper feed unit 50, etc.) that are originally provided in the main body unit 1.

Thus, when the image forming apparatus is in the second state, electricity is supplied only by the main-body power source 7 provided in the main body unit 1. In addition, when the image forming apparatus is in the second state, the main-body controller 8 provided in the main body unit 1 performs the control process by itself.

An image forming operation performed by the image forming apparatus according to the present exemplary embodiment will now be described. When the image forming apparatus is set to the first state as illustrated in FIG. 1, the image forming apparatus is capable of performing an operation of forming a color image on a single sheet of paper S by using two to four of the yellow, magenta, cyan, and black toners and an operation of forming a monochrome image on a single sheet of paper S by using one of the yellow, magenta, cyan, and black toners. In the following description, the operation of forming a color image is referred to as a "color mode" operation, and the operation of forming a monochrome image is referred to as a "monochrome mode" operation. An operation of forming a full-color image on a single sheet of paper S by using all of the toners of the four colors will be described as an example of the "color mode" operation, and an operation of forming a monochrome image on a single sheet of paper S by using black toner will be explained as an example of the "monochrome mode" operation. When the image forming apparatus is set to the second state as illustrated in FIG. 2, the image forming apparatus is capable of performing only an operation of forming a monochrome image on a single sheet of paper S by using toner of single color. In the following operation, this operation is referred to as a "monochrome operation". An operation of forming a monochrome image on a single sheet of paper S by using black toner will be explained as an example of the "monochrome operation".

The "color mode" and "monochrome mode" operations performed by the image forming apparatus in the first state and the "monochrome operation" performed by the image forming apparatus in the second state will be described below. In the following description, it is assumed that the sheets of paper S on which images are formed have the same size and are in the same orientation. In addition, in the following description, the main-body controller 8 and/or the first-transfer-unit controller 28 is/are referred to simply as a "controller".

In each of the "color mode" operation, the "monochrome mode" operation, and the "monochrome operation", the circumferential speed of the photoconductor drum 11 that rotates in the direction shown by arrow A is referred to as a photoconductor circumferential speed Vp, and the circumferential speed of the supply rollers 54 that rotate is referred to as a supply circumferential speed Vs. In addition, the circumferential speed of the transfer drum 21 that rotates in the direction shown by arrow B in each of the "color mode" and "monochrome mode" operations and the circumferential speed of the transfer roller 31 that rotates in the direction shown by arrow B in the "monochrome operation" are referred to as a transfer circumferential speed Vt. In each of the "color mode" and "monochrome mode" operations, the photoconductor circumferential speed Vp is set to be higher than the transfer circumferential speed Vt by less than about 1%, and the supply circumferential speed Vs is also set to be higher than the transfer circumferential speed Vt by less than about 1%. Therefore, in both the "color mode" and "monochrome mode" operations, $Vt<Vp<Vs$ is satisfied. In the "monochrome operation", the transfer roller 31 is rotated by the rotation of the photoconductor drum 11, and the supply circumferential speed Vs is set to be higher than the photoconductor circumferential speed Vp by less than about 1%. Therefore, in the "monochrome operation", $Vp \approx Vt<Vs$ is satisfied.

Color Mode

Figure 13:
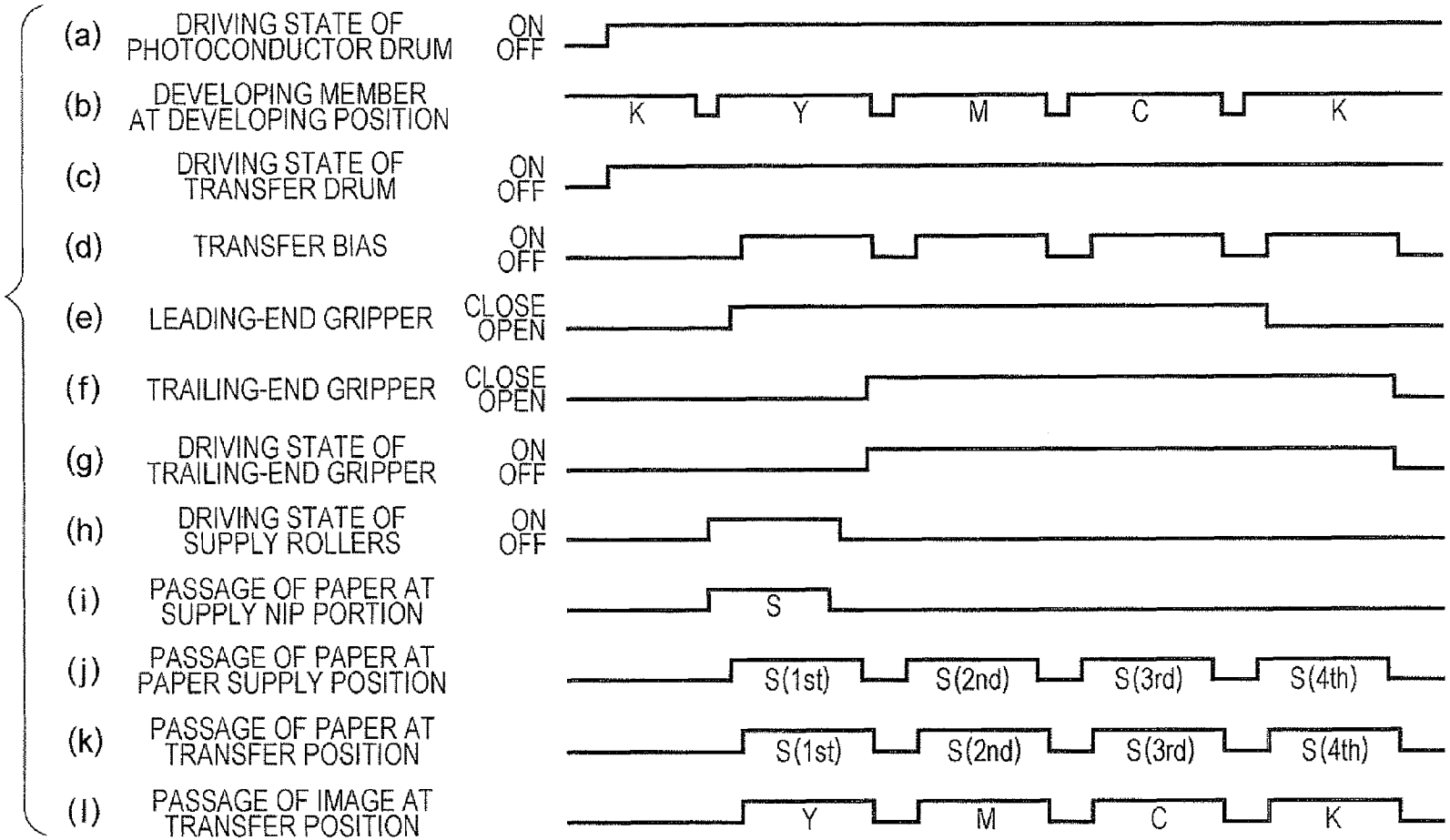
FIG. 13 is a timing chart illustrating an example of an image forming operation in a "color mode" in which a full-color image is formed by the image forming apparatus set to the first state.

FIG. 13 is an example of a timing chart of the "color mode" operation performed by the image forming apparatus that is set to the first state as illustrated in FIG. 1 so as to function as a monochrome-color apparatus. In this example, the image forming apparatus forms a full-color image with four colors, which are yellow, magenta, cyan, and black, on a single sheet of paper S.

FIG. 13 illustrates (a) the driving state (ON/OFF) of the photoconductor drum 11; (b) the developing member placed at the developing position; (c) the driving state (ON/OFF) of the transfer drum 21; (d) the state of application (ON/OFF) of the transfer bias to the transfer drum 21; (e) the state (OPEN/CLOSED) of the leading-end gripper 22; (f) the state (OPEN/CLOSED) of the trailing-end gripper 23; (g) the driving state (ON/OFF) of the trailing-end gripper 23; (h) the driving state (ON/OFF) of the supply rollers 54; (i) passage of the sheet of paper S at the supply nip portion N; (j) passage of the sheet of paper S at the paper supply position P; (k) passage of the sheet of paper S at the transfer position Tr; and (l) passage of the image on the photoconductor drum 11 at the transfer position Tr, with respect to time.

In FIG. 13, "Y", "M", "C", and "K" correspond to yellow, magenta, cyan, and black, respectively. In addition, in FIG. 13, "1st", "2nd", "3rd", and "4th" show the number of times the same sheet of paper S passes the paper supply position P on the outer peripheral surface of the transfer drum 21 or the transfer position Tr. Therefore, for example, "S(2nd)" in part (k) (PASSAGE OF SHEET AT TRANSFER POSITION) in FIG. 13 means that the sheet of paper S that has passed the transfer position Tr once is passing the transfer position Tr again (for the second time).

In the initial state before the full-color image forming operation in the color mode is started, the driving states of all of the photoconductor drum 11, the transfer drum 21, and the supply rollers 54 are OFF. In addition, in the initial state, the state of application of the transfer bias to the transfer drum 21 is also OFF. In addition, in the initial state, both the leading-end gripper 22 and the trailing-end gripper 23 are set to the OPEN state. In the first state, the color developing unit 14 including the rotary developing device 14D is attached to the main body unit 1. Accordingly, in the initial state, the black developing member 14K is stopped at the developing position (see FIG. 1). In addition, the first transfer unit 20 is attached to the main body unit 1 in the first state. Accordingly, in the initial state, the trailing-end gripper 23 is stopped at the standby position (see FIG. 1).

When the image forming operation in the color mode is started, the controller switches the driving states of the photoconductor drum 11 and the transfer drum 21 from OFF to ON. Accordingly, the photoconductor drum 11 is rotated at the photoconductor circumferential speed Vp and the transfer drum 21 is rotated at the transfer circumferential speed Vt. The photoconductor drum 11 and the transfer drum 21 are rotated in the same direction at the transfer position Tr while being in contact with each other.

Next, the controller rotates the rotary developing device 14D to place the yellow developing member 14Y at the developing position. Then, the controller drives the charging device 12, the exposure device 13, and the developing member placed at the developing position (the yellow developing member 14Y in this case). Accordingly, the photosensitive layer of the photoconductor drum 11 that rotates is charged by the charging device 12, and is then subjected to the exposure process performed by the exposure device 13. As a result, an electrostatic latent image is formed on the photoconductor drum 11. Then, the electrostatic latent image formed on the photoconductor drum 11 is developed by the yellow developing member 14Y, so that a yellow toner image corresponding to the electrostatic latent image is formed on the photoconductor drum 11. Subsequently, the yellow toner image formed on the photoconductor drum 11 is moved toward the transfer position Tr as the photoconductor drum 11 is further rotated.

In response to the start of the image forming operation in the color mode, the controller causes the paper feed unit 50 to feed a sheet of paper S. More specifically, the controller causes the pickup roller 52 to pick up sheets of paper S from the paper container 51 and causes the separation roller 53 to separate the sheets of paper S from each other. Accordingly, a sheet of paper S is fed into the paper supply path 61. At this time, the controller maintains the driving state of the supply rollers 54 to OFF, so that the leading end of the sheet of paper S that has been fed into the paper supply path 61 comes into contact with the entrance of the supply nip portion N between the supply rollers 54 and is stopped. Thus, skewing of the sheet of paper S is corrected. The controller switches the driving state of the supply rollers 54 from OFF to ON and causes the supply rollers 54 to rotate at the supply circumferential speed Vs such that the leading end of the sheet of paper S reaches the paper supply position P at the time when the leading-end gripper 22 attached to the transfer drum 21 that rotates reaches the paper supply position P. Accordingly, the movement of the sheet of paper S is restarted so that the sheet of paper S passes through the supply nip portion N and is transported along the paper supply path 61 to the paper supply position P. The controller switches the leading-end gripper 22 from the open state to the closed state when the leading end of the sheet of paper S reaches the paper supply position P. As a result, the leading end of the sheet of paper S is mechanically retained on the transfer drum 21. A leading end portion of the sheet of paper S is transported along the rotation path 62 while being wrapped around the elastic layer 21B of the transfer drum 21, and a trailing end portion of the sheet of paper S is transported along the paper supply path 61 while being nipped by the supply rollers 54 at the supply nip portion N.

The leading end of the sheet of paper S that is retained on the transfer drum 21 by the leading-end gripper 22 reaches the transfer position Tr (first time) after passing the paper supply position P and the trailing-end gripper 23 that is stopped at the standby position. The controller controls the exposure device 13 on the basis of a phase signal from the phase sensor (not shown) so that the leading end of an area of the photoconductor drum 11 in which the yellow toner image is formed in the moving direction thereof reaches the transfer position Tr at the time when the leading end of the sheet of paper S retained on the transfer drum 21 reaches the transfer position Tr. The controller switches the state of application of the transfer bias to the transfer drum 21 from OFF to ON before the leading end of the sheet of paper S reaches the transfer position Tr. Accordingly, transferring of the yellow toner image onto the sheet of paper S (first color) is started at the transfer position Tr.

In this example, the trailing end of the sheet of paper S passes the supply nip portion N and the paper supply position P after the leading end of the sheet of paper S has reached the transfer position Tr. The controller changes the driving state of the supply rollers 54 from ON to OFF to stop the rotation of the supply rollers 54 after the trailing end of the sheet of paper S has passed the supply nip portion N. The controller switches the trailing-end gripper 23 from the open state to the closed state when the trailing end of the sheet of paper S reaches the position opposed to the trailing-end gripper 23 that is stopped at the standby position. The controller also causes the trailing-end gripper 23 to rotate in the same direction as that of the transfer drum 21 at the same circumferential speed as the transfer circumferential speed Vt of the transfer drum 21. Accordingly, the trailing end of the sheet of paper S is mechanically retained on the transfer drum 21. Thus, the leading end and the trailing end of the sheet of paper S are retained by the leading-end gripper 22 and the trailing-end gripper 23, respectively. As a result, the entire body of the sheet of paper S is transported along the rotation path 62 while being wrapped around the elastic layer 213 of the transfer drum 21.

In this example, the process of developing the yellow toner image for the sheet of paper S is ended after the trailing end of the sheet of paper S has reached the paper supply position P. Subsequently, the trailing end of the sheet of paper S retained on the transfer drum 21 passes the transfer position Tr. The controller switches the state of application of the transfer bias to the transfer drum 21 from ON to OFF when the trailing end of the sheet of paper S passes the transfer position Tr. Thus, the transferring of the yellow toner image onto the sheet of paper S is ended. In this example, after the transferring of the yellow toner image onto the sheet of paper S is ended, the controller drives the rotary developing device 14D and switches the developing member placed at the developing position (from the yellow developing member 14Y to the magenta developing member 14M). Then, the controller starts the process of forming a magenta toner image on the photoconductor drum 11.

During the period in which the transfer bias is applied to the transfer drum 21, the yellow image formed on the photoconductor drum 11 passes the transfer position Tr ("Y" in part (l) of FIG. 13) and the sheet of paper S passes the transfer position Tr the first time ("S(1st)" in part (k) of FIG. 13).

The exposed portion 21C of the transfer drum 21 passes the transfer position Tr as the transfer drum 21 rotates, and then the leading end of the sheet of paper S that is retained on the transfer drum 21 and moved along the rotation path 62 reaches the transfer position Tr (second time). The controller controls the exposure device 13 and the rotary developing device 14D on the basis of a phase signal from the phase sensor (not shown) so that the leading end of an area of the photoconductor drum 11 in which the magenta toner image is formed in the moving direction thereof reaches the transfer position Tr at the time when the leading end of the sheet of paper S retained on the transfer drum 21 reaches the transfer position Tr. The controller switches the state of application of the transfer bias to the transfer drum 21 from OFF to ON before the leading end of the sheet of paper S reaches the transfer position Tr. Accordingly, transferring of the magenta toner image onto the sheet of paper S (second color) is started at the transfer position Tr.

In this example, the process of developing the magenta toner image for the sheet of paper S is ended after the trailing end of the sheet of paper S has reached the paper supply position P. Subsequently, the trailing end of the sheet of paper S retained on the transfer drum 21 passes the transfer position Tr. The controller switches the state of application of the transfer bias to the transfer drum 21 from ON to OFF when the trailing end of the sheet of paper S passes the transfer position Tr. Thus, the transferring of the magenta toner image onto the sheet of paper S is ended. In this example, after the transferring of the magenta toner image onto the sheet of paper S is ended, the controller drives the rotary developing device 14D and switches the developing member placed at the developing position (from the magenta developing member 14M to the cyan developing member 14C). Then, the controller starts the process of forming a cyan toner image on the photoconductor drum 11.

During the period in which the transfer bias is applied to the transfer drum 21, the magenta image formed on the photoconductor drum 11 passes the transfer position Tr ("M" in part (l) of FIG. 13) and the sheet of paper S passes the transfer position Tr the second time ("S(2nd)" in part (k) of FIG. 13).

The exposed portion 21C of the transfer drum 21 passes the transfer position Tr as the transfer drum 21 rotates, and then the leading end of the sheet of paper S that is retained on the transfer drum 21 and moved along the rotation path 62 reaches the transfer position Tr (third time). The controller controls the exposure device 13 and the rotary developing device 14D on the basis of a phase signal from the phase sensor (not shown) so that the leading end of an area of the photoconductor drum 11 in which the cyan toner image is formed in the moving direction thereof reaches the transfer position Tr at the time when the leading end of the sheet of paper S retained on the transfer drum 21 reaches the transfer position Tr. The controller switches the state of application of the transfer bias to the transfer drum 21 from OFF to ON before the leading end of the sheet of paper S reaches the transfer position Tr. Accordingly, transferring of the cyan toner image onto the sheet of paper S (third color) is started at the transfer position Tr.

In this example, the process of developing the cyan toner image for the sheet of paper S is ended after the trailing end of the sheet of paper S has reached the paper supply position P. Subsequently, the trailing end of the sheet of paper S retained on the transfer drum 21 passes the transfer position Tr. The controller switches the state of application of the transfer bias to the transfer drum 21 from ON to OFF when the trailing end of the sheet of paper S passes the transfer position Tr. Thus, the transferring of the cyan toner image onto the sheet of paper S is ended. In this example, after the transferring of the cyan toner image onto the sheet of paper S is ended, the controller drives the rotary developing device 14D and switches the developing member placed at the developing position (from the cyan developing member 14C to the black developing member 14K). Then, the controller starts the process of forming a black toner image on the photoconductor drum 11.

During the period in which the transfer bias is applied to the transfer drum 21, the cyan image formed on the photoconductor drum 11 passes the transfer position Tr ("C" in part (l) of FIG. 13) and the sheet of paper S passes the transfer position Tr the third time ("S(3rd)" in part (k) of FIG. 13).

The exposed portion 21C of the transfer drum 21 passes the transfer position Tr as the transfer drum 21 rotates, and then the leading end of the sheet of paper S that is retained on the transfer drum 21 and moved along the rotation path 62 reaches the transfer position Tr (fourth time). The controller controls the exposure device 13 and the rotary developing device 14D on the basis of a phase signal from the phase sensor (not shown) so that the leading end of an area of the photoconductor drum 11 in which the black toner image is formed in the moving direction thereof reaches the transfer position Tr at the time when the leading end of the sheet of paper S retained on the transfer drum 21 reaches the transfer position Tr. The controller switches the state of application of the transfer bias to the transfer drum 21 from OFF to ON before the leading end of the sheet of paper S reaches the transfer position Tr. Accordingly, transferring of the black toner image onto the sheet of paper S (fourth color) is started at the transfer position Tr.

In this example, the controller switches the leading-end gripper 22 from the closed state to the open state when the leading end of the sheet of paper S reaches the transfer position Tr. Accordingly, the leading end of the sheet of paper S is released from the retained state. The sheet of paper S that has passed the transfer position Tr becomes separated from the rotation path 62 and is moved toward the fixing unit 40 along the paper output path 63 while being guided by the fixing guide 71 provided in the main body unit 1. The full-color toner image formed on the sheet of paper S in a superimposed manner is fixed to the sheet of paper S when the sheet of paper S passes through the fixing nip portion of the fixing unit 40.

In this example, the process of developing the black toner image for the sheet of paper S is ended after the trailing end of the sheet of paper S has reached the paper supply position P. Subsequently, the controller switches the trailing-end gripper 23 from the closed state to the open state and stops the rotation of the trailing-end gripper 23 when the trailing end of the sheet of paper S reaches the standby position. Accordingly, the trailing end of the sheet of paper S is released from the retained state and the trailing-end gripper 23 is stopped at the standby position again. The controller switches the state of application of the transfer bias to the transfer drum 21 from ON to OFF after the trailing end of the sheet of paper S passes the transfer position Tr. Thus, the transferring of the black toner image onto the sheet of paper S is ended.

Then, the sheet of paper S passes through the fixing unit 40 and is transported by the paper output rollers 72. Thus, the sheet of paper S is transported along the paper output path 63 and placed on the paper receiver 3.

During the period in which the transfer bias is applied to the transfer drum 21, the black image formed on the photoconductor drum 11 passes the transfer position Tr ("K" in part (l) of FIG. 13) and the sheet of paper S passes the transfer position Tr the fourth time ("S(4th)" in part (k) of FIG. 13).

Monochrome Mode

Figure 14:
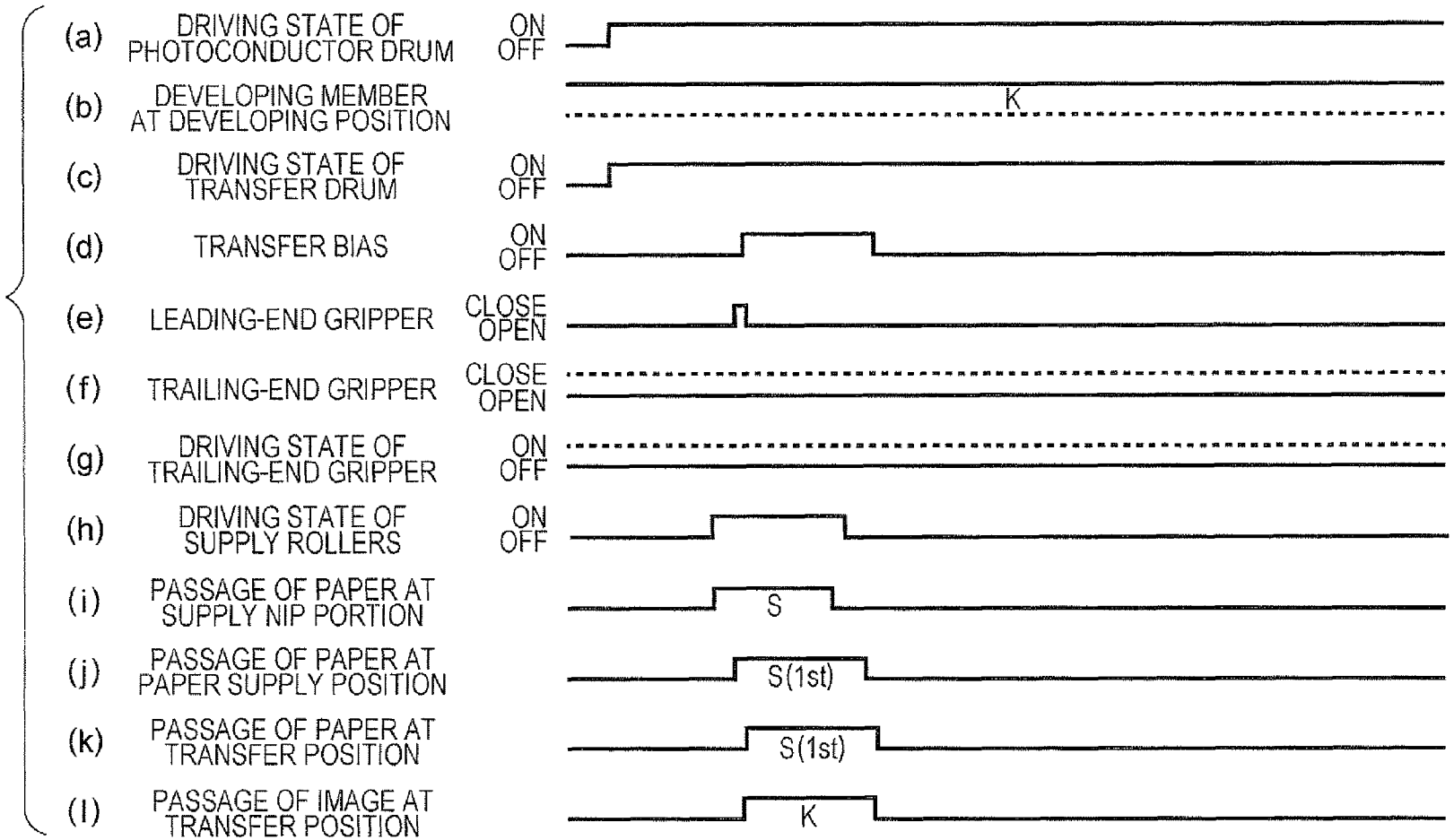
FIG. 14 is a timing chart illustrating an example of an image forming operation in a "monochrome mode" in which a monochrome image is formed by the image forming apparatus set to the first state.

FIG. 14 is an example of a timing chart of the "monochrome mode" operation performed by the image forming apparatus that is set to the first state as illustrated in FIG. 1 so as to function as a monochrome-color apparatus. In this example, the image forming apparatus forms a black monochrome image on a single sheet of paper S. The symbols shown in FIG. 14, preconditions of the components, and the initial state are similar to those in the "color mode" operation described above with reference to FIG. 13.

When the image forming operation in the monochrome mode is started, the controller switches the driving states of the photoconductor drum 11 and the transfer drum 21 from OFF to ON. Accordingly, the photoconductor drum 11 is rotated at the photoconductor circumferential speed Vp and the transfer drum 21 is rotated at the transfer circumferential speed Vt. The photoconductor drum 11 and the transfer drum 21 are rotated in the same direction at the transfer position Tr while being in contact with each other.

In the case where a black image is formed in the monochrome mode, the controller drives the charging device 12, the exposure device 13, and the developing member at the developing position (the black developing member 14K in this case) without rotating the rotary developing device 14D that is positioned such that the black developing member 14K is at the developing position. Accordingly, the photosensitive layer of the photoconductor drum 11 that rotates is charged by the charging device 12, and is then subjected to the exposure process performed by the exposure device 13. As a result, an electrostatic latent image is formed on the photoconductor drum 11. Then, the electrostatic latent image formed on the photoconductor drum 11 is developed by the black developing member 14K, so that a black toner image corresponding to the electrostatic latent image is formed on the photoconductor drum 11. Subsequently, the black toner image formed on the photoconductor drum 11 is moved toward the transfer position Tr as the photoconductor drum 11 is further rotated.

In response to the start of the image forming operation in the monochrome mode, the controller causes the paper feed unit 50 to supply a sheet of paper S. More specifically, the controller causes the pickup roller 52 to pick up sheets of paper S from the paper container 51 and causes the separation roller 53 to separate the sheets of paper S from each other. Accordingly, a sheet of paper S is fed into the paper supply path 61. At this time, the controller maintains the driving state of the supply rollers 54 to OFF, so that the leading end of the sheet of paper S that has been fed into the paper supply path 61 comes into contact with the entrance of the supply nip portion N between the supply rollers 54 and is stopped. Thus, skewing of the sheet of paper S is corrected. The controller switches the driving state of the supply rollers 54 from OFF to ON and causes the supply rollers 54 to rotate at the supply circumferential speed Vs such that the leading end of the sheet of paper S reaches the paper supply position P at the time when the leading-end gripper 22 attached to the transfer drum 21 that rotates reaches the paper supply position P. Accordingly, the supply of the sheet of paper S is restarted so that the sheet of paper S passes through the supply nip portion N and is transported along the paper supply path 61 to the paper supply position P. The controller switches the leading-end gripper 22 from the open state to the closed state when the leading end of the sheet of paper S reaches the paper supply position P. As a result, the leading end of the sheet of paper S is mechanically retained on the transfer drum 21. A leading end portion of the sheet of paper S is transported along the rotation path 62 while being wrapped around the elastic layer 21B of the transfer drum 21, and a trailing end portion of the sheet of paper S is transported along the paper supply path 61 while being nipped by the supply rollers 54 at the supply nip portion N.

The leading end of the sheet of paper S that is retained on the transfer drum 21 by the leading-end gripper 22 reaches the transfer position Tr (first time) after passing the paper supply position P and the trailing-end gripper 23 that is stopped at the standby position. The controller controls the exposure device 13 on the basis of a phase signal from the phase sensor (not shown) so that the leading end of an area of the photoconductor drum 11 in which the black toner image is formed in the moving direction thereof reaches the transfer position Tr at the time when the leading end of the sheet of paper S retained on the transfer drum 21 reaches the transfer position Tr. The controller switches the state of application of the transfer bias to the transfer drum 21 from OFF to ON before the leading end of the sheet of paper S reaches the transfer position Tr. Accordingly, transferring of the black toner image onto the sheet of paper S (first color) is started at the transfer position Tr.

In this example, the controller switches the leading-end gripper 22 from the closed state to the open state when the leading end of the sheet of paper S reaches the transfer position Tr. Accordingly, the leading end of the sheet of paper S is released from the retained state. The sheet of paper S that has passed the transfer position Tr becomes separated from the rotation path 62 and is moved toward the fixing unit 40 along the paper output path 63 while being guided by the fixing guide 71 provided in the main body unit 1. The black toner image formed on the sheet of paper S in a superimposed manner is fixed to the sheet of paper S when the sheet of paper S passes through the fixing nip portion of the fixing unit 40.

In this example, the trailing end of the sheet of paper S passes the supply nip portion N and the paper supply position P after the leading end of the sheet of paper S has reached the transfer position Tr. The controller changes the driving state of the supply rollers 54 from ON to OFF to stop the rotation of the supply rollers 54 after the trailing end of the sheet of paper S has passed the supply nip portion N. Then, the trailing end of the sheet of paper S passes the position opposed to the trailing-end gripper 23 that is stopped at the standby position. In the monochrome mode, the controller maintains the trailing-end gripper 23 in the open state.

In this example, the process of developing the black toner image for the sheet of paper S is ended after the trailing end of the sheet of paper S has reached the paper supply position P. Subsequently, the trailing end of the sheet of paper S passes the transfer position Tr. The controller switches the state of application of the transfer bias to the transfer drum 21 from ON to OFF when the trailing end of the sheet of paper S passes the transfer position Tr. Thus, the transferring of the black toner image onto the sheet of paper S is ended. In this example, the controller does not rotate the rotary developing device 14D even when the transferring of the black toner image onto the sheet of paper S is ended. Accordingly, the black developing member 14K remains at the developing position.

Then, the sheet of paper S passes through the fixing unit 40 and is transported by the paper output rollers 72. Thus, the sheet of paper S is transported along the paper output path 63 and placed on the paper receiver 3.

During the period in which the transfer bias is applied to the transfer drum 21, the black image formed on the photoconductor drum 11 passes the transfer position Tr ("K" in part (l) of FIG. 14) and the sheet of paper S passes the transfer position Tr the first time ("S(1st)" in part (k) of FIG. 14).

Thus, in the monochrome mode, unlike the color mode, the process of switching the developing member by rotating the rotary developing device 14D, the process of retaining the sheet of paper S with the trailing-end gripper 23, and the process of rotating the trailing-end gripper 23 are not performed.

Monochrome Operation

Figure 15:
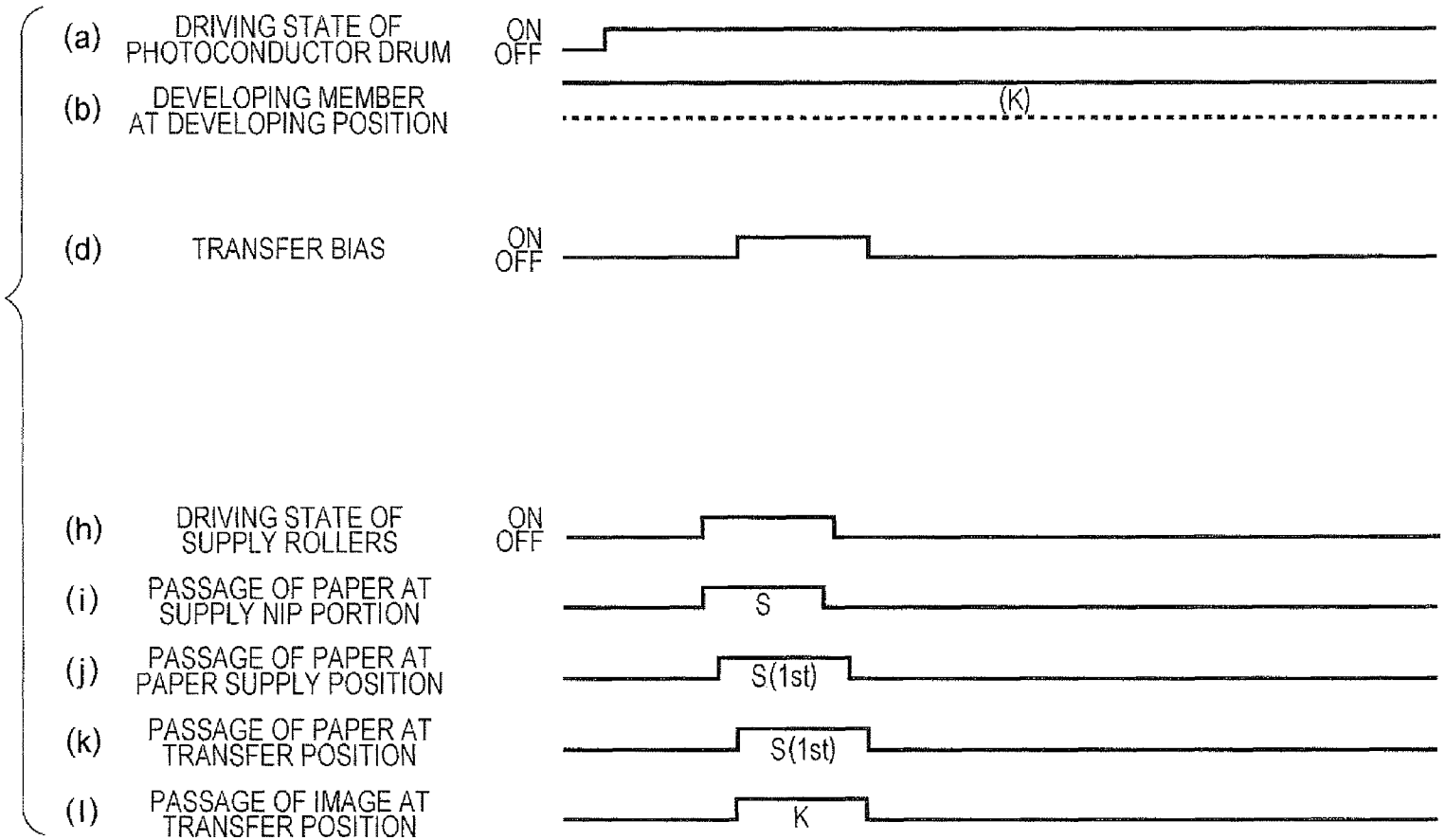
FIG. 15 is a timing chart illustrating an example of a "monochrome operation", which is an image forming operation in which a monochrome image is formed by the image forming apparatus set to the second state.

FIG. 15 is an example of a timing chart of the "monochrome operation" performed by the image forming apparatus that is set to the second state as illustrated in FIG. 2 so as to function as a monochrome-only apparatus. In this example, the image forming apparatus forms a black monochrome image on a single sheet of paper S.

FIG. 15 illustrates (a) the driving state (ON/OFF) of the photoconductor drum 11; (b) the developing member placed at the developing position; (d) the state of application (ON/OFF) of the transfer bias to the transfer roller 31; (h) the driving state (ON/OFF) of the supply rollers 54; (i) passage of the sheet of paper S at the supply nip portion N; (j) passage of the sheet of paper S at the paper supply position P; (k) passage of the sheet of paper S at the transfer position Tr; and (l) passage of the image on the photoconductor drum 11 at the transfer position Tr, with respect to time. FIG. 15 differs from FIGS. 13 and 14 in that since the transfer roller 31 is provided in place of the transfer drum 21, (c) the driving state of the transfer drum 21, (e) the state of the leading-end gripper 22; (f) the state of the trailing-end gripper 23; and (g) the driving state of the trailing-end gripper 23 do not exist. In addition, (d) transfer bias is applied to the transfer roller 31 instead of the transfer drum 21.

In the initial state before the monochrome image forming operation is started, the driving states of the photoconductor drum 11 and the supply rollers 54 are OFF. In addition, in the initial state, the state of application of the transfer bias to the transfer roller 31 is also OFF. In the second state, the monochrome developing unit 16 including the monochrome developing member 16D is attached to the main body unit 1. Accordingly, the monochrome developing member 16D containing black toner is constantly placed at the developing position (see FIG. 2).

When the image forming operation is started, the controller switches the driving state of the photoconductor drum 11 from OFF to ON. Accordingly, the photoconductor drum 11 is rotated at the photoconductor circumferential speed Vp. When the photoconductor drum 11 starts to rotate, the transfer roller 31 receives the driving force from the photoconductor drum 11 at the transfer position Tr and is rotated at the transfer circumferential speed Vt (≈photoconductor circumferential speed Vp). The photoconductor drum 11 and the transfer roller 31 are rotated in the same direction at the transfer position Tr while being in contact with each other.

Next, the controller drives the charging device 12, the exposure device 13, and the monochrome developing member 16D. Accordingly, the photosensitive layer of the photoconductor drum 11 that rotates is charged by the charging device 12, and is then subjected to the exposure process performed by the exposure device 13. As a result, an electrostatic latent image is formed on the photoconductor drum 11. Then, the electrostatic latent image formed on the photoconductor drum 11 is developed by the monochrome developing member 161, so that a monochrome (black in this example) toner image corresponding to the electrostatic latent image is formed on the photoconductor drum 11. Subsequently, the black toner image formed on the photoconductor drum 11 is moved toward the transfer position Tr as the photoconductor drum 11 is further rotated.

In response to the start of the image forming operation, the controller causes the paper feed unit 50 to feed a sheet of paper S. More specifically, the controller causes the pickup roller 52 to pick up sheets of paper S from the paper container 51 and causes the separation roller 53 to separate the sheets of paper S from each other. Accordingly, a sheet of paper S is fed into the paper supply path 61. At this time, the controller maintains the driving state of the supply rollers 54 to OFF, so that the leading end of the sheet of paper S that has been fed into the paper supply path 61 comes into contact with the entrance of the supply nip portion N between the supply rollers 54 and is stopped. Thus, skewing of the sheet of paper S is corrected. The controller switches the driving state of the supply rollers 54 from OFF to ON and causes the supply rollers 54 to rotate at the supply circumferential speed Vs after skewing of the sheet of paper S is corrected. Accordingly, the movement of the sheet of paper S is restarted so that the sheet of paper S passes through the supply nip portion N and is transported along the paper supply path 61 to the paper supply position P.

Then, the leading end of the sheet of paper S passes the paper supply position P and is transported to the transfer position Tr (first time) while being guided by the entrance guide 32 provided on the second transfer unit 30. The controller controls the exposure device 13 and the supply rollers 54 so that the leading end of an area of the photoconductor drum 11 in which the black toner image is formed in the moving direction thereof reaches the transfer position Tr at the time when the leading end of the sheet of paper S reaches the transfer position Tr. The controller switches the state of application of the transfer bias to the transfer roller 31 from OFF to ON when the leading end of the sheet of paper S reaches the transfer position Tr. Accordingly, transferring of the black toner image onto the sheet of paper S (first color) is started at the transfer position Tr. The sheet of paper S that has passed the transfer position Tr is moved toward the fixing unit 40 along the paper output path 63 by being guided by the exit guide 33 provided in the second transfer unit 30 and the fixing guide 71 provided in the main body unit 1. The black toner image formed on the sheet of paper S is fixed to the sheet of paper S when the sheet of paper S passes through the fixing nip portion.

In this example, the trailing end of the sheet of paper S passes the supply nip portion N and the paper supply position P after the leading end of the sheet of paper S has reached the transfer position Tr. The controller changes the driving state of the supply rollers 54 from ON to OFF to stop the rotation of the supply rollers 54 after the trailing end of the sheet of paper S has passed the supply nip portion N.

In this example, the process of developing the black toner image for the sheet of paper S is ended after the trailing end of the sheet of paper S has passed the supply nip portion N. Subsequently, the trailing end of the sheet of paper S passes the transfer position Tr. The controller switches the state of application of the transfer bias to the transfer roller 31 from ON to OFF when the trailing end of the sheet of paper S passes the transfer position Tr. Thus, the transferring of the black toner image onto the sheet of paper S is ended.

Then, the sheet of paper S passes through the fixing unit 40 and is transported by the paper output rollers 72. Thus, the sheet of paper S is transported along the paper output path 63 and placed on the paper receiver 3.

During the period in which the transfer bias is applied to the transfer roller 31, the black image formed on the photoconductor drum 11 passes the transfer position Tr ("K" in part (l) of FIG. 15) and the sheet of paper S passes the transfer position Tr the first time ("S(1st)" in part (k) of FIG. 15).

In the present exemplary embodiment, the developing bias and the transfer bias are supplied by the main-body power source 7 provided in the main body unit 1 in both of the cases in which the image forming apparatus is set to the first state and the second state. However, the present invention is not limited to this. For example, the developing bias and the transfer bias may be supplied by the first-transfer-unit power source 27 provided in the first transfer unit 20 when the image forming apparatus is set to the first state, and be supplied by the main-body power source 7 provided in the main body unit 1 when the image forming apparatus is set to the second state.

In addition, in the present exemplary embodiment, the first-transfer-unit controller 28 is provided in the first transfer unit 20. When the image forming apparatus is set to the first state, the main-body controller 8 provided in the main body unit 1 and the first-transfer-unit controller 28 provided in the first transfer unit 20 are operated in cooperation with each other to control each part. However, the present invention is not limited to this. For example, the first transfer unit 20 may be free from a controller, and each part may be controlled only by the main-body controller 8 provided in the main body unit 1 in both of the cases in which the image forming apparatus is se to the first state and the second state.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a main body portion including an image carrier that is rotatable, an image-carrier driving unit that rotates the image carrier, a latent-image forming unit that forms an electrostatic latent image on the image carrier, a developing-unit attachment section to which a developing unit is attached, the developing unit developing the electrostatic latent image that is formed on the image carrier by the latent-image forming unit, and a transfer-unit attachment section to which a transfer unit is attached, the transfer unit facing the image carrier, being rotatable, and transferring an image formed on the image carrier by the latent-image forming unit and the developing unit attached to the developing-unit attachment section onto a recording medium interposed between the transfer unit and the image carrier at a transfer position at which the transfer unit faces the image carrier, wherein the developing-unit attachment section provided in the main body portion is capable of receiving, as the developing unit, a first developing unit or a second developing unit, the first developing unit having a plurality of developing members and the second developing unit having a single developing member, wherein the transfer-unit attachment section provided in the main body portion is capable of receiving, as the transfer unit, a first transfer unit or a second transfer unit, the first transfer unit including a first transfer member that is rotatable and has a function of retaining the recording medium and a first transfer driving unit that rotates the first transfer member, and the second transfer unit including a second transfer member that is rotatable and that does not have a function of retaining the recording medium, and wherein, when the first developing unit is attached to the developing-unit attachment section provided in the main body portion and the first transfer unit is attached to the transfer-unit attachment section provided in the main body portion, the first transfer driving unit provided in the first transfer unit is mechanically connected to the first developing unit.

2. The image forming apparatus according to claim 1, wherein, when the second developing unit is attached to the developing-unit attachment section provided in the main body portion and the second transfer unit is attached to the transfer-unit attachment section provided in the main body portion, the image-carrier driving unit provided in the main body portion is mechanically connected to the second developing unit.

3. The image forming apparatus according to claim 1, wherein the first developing unit includes a rotary developing unit in which the plurality of developing members rotate around an axis and in which one of the plurality of developing members stops at a developing position at which the rotary developing unit faces the image carrier, each of the plurality of developing members including a rotating member that is rotatable, and wherein, when the first developing unit is attached to the developing-unit attachment section and the first transfer unit is attached to the transfer-unit attachment section in the main body portion, the rotary developing unit is rotated around the axis or stopped by the first transfer driving unit provided in the first transfer unit.

4. The image forming apparatus according to claim 1, wherein the first developing unit includes a rotary developing unit in which the plurality of developing members rotate around an axis and in which one of the plurality of developing members stops at a developing position at which the rotary developing unit faces the image carrier, each of the plurality of developing members including a rotating member that is rotatable, and wherein, when the first developing unit is attached to the developing-unit attachment section and the first transfer unit is attached to the transfer-unit attachment section in the main body portion, the rotating member provided in the developing member that is stopped at the developing position is rotated by the first transfer driving unit provided in the first transfer unit.

5. The image forming apparatus according to claim 1, wherein the main body portion further includes a main-body power source that supplies electricity to the image-carrier driving unit, and wherein the first transfer unit further includes a first-transfer-unit power source that supplies electricity to the first transfer driving unit when the first transfer unit is attached to transfer-unit attachment section provided in the main body portion.

6. The image forming apparatus according to claim 1, wherein the main body portion further includes a main-body controller that controls the image-carrier driving unit, and wherein the first transfer unit further includes a first-transfer-unit controller that controls the first transfer driving unit when the first transfer unit is attached to transfer-unit attachment section provided in the main body portion.

7. The image forming apparatus according to claim 1, wherein a diameter of the first transfer member provided in the first transfer unit is larger than a diameter of the second transfer member provided in the second transfer unit.

* * * * *